US011669053B2

(12) United States Patent
Hachiya et al.

(10) Patent No.: US 11,669,053 B2
(45) **Date of Patent: *Jun. 6, 2023**

(54) ELECTRONIC DEVICE AND COMPUTER-READABLE NON-TRANSITORY RECORDING MEDIUM

(71) Applicant: KYOCERA Corporation, Kyoto (JP)

(72) Inventors: Hidetoshi Hachiya, Yokohama (JP); Tomomi Nagao, Kawasaki (JP)

(73) Assignee: KYOCERA CORPORATION, Kyoto (JP)

( * ) Notice: Subject to any disclaimer, the term of this patent is extended or adjusted under 35 U.S.C. 154(b) by 28 days.

This patent is subject to a terminal disclaimer.

(21) Appl. No.: 17/387,928

(22) Filed: Jul. 28, 2021

(65) Prior Publication Data

US 2021/0356913 A1 Nov. 18, 2021

Related U.S. Application Data

(63) Continuation of application No. 16/303,661, filed as application No. PCT/JP2017/019569 on May 25, 2017, now Pat. No. 11,106,181.

(30) Foreign Application Priority Data

May 27, 2016 (JP) ..... JP2016-106068

(51) Int. Cl.
*G04G 9/00* (2006.01)
*G04C 10/02* (2006.01)
(Continued)

(52) U.S. Cl.
CPC ..... *G04G 9/007* (2013.01); *G04C 10/02* (2013.01); *G04G 19/12* (2013.01); *G04G 21/02* (2013.01); *G04G 21/06* (2013.01)

(58) Field of Classification Search
CPC ..... G04G 9/007; G04G 19/12; G04G 21/02; G04G 21/06; G04G 21/00; G04G 9/00; G04C 10/02
See application file for complete search history.

(56) References Cited

U.S. PATENT DOCUMENTS 10,401,800 B2 * 9/2019 Cardinali ..... G04G 21/00
11,106,181 B2 * 8/2021 Hachiya ..... G04G 9/0017
(Continued)

FOREIGN PATENT DOCUMENTS

JP S613226 A 1/1986
JP S62277591 A 12/1987
(Continued)

*Primary Examiner* — Edwin A. Leon
(74) *Attorney, Agent, or Firm* — Hauptman Ham, LLP

(57) ABSTRACT

An electronic device comprises a body and a band being able to attach the body to a part of a human body. The body comprises first and second detectors and at least one processor. The first detector detects illuminance on an upper surface of the body. The second detector is located in a position distant from a position of the first detector in a short-side direction of the band and detects the illuminance on the upper surface of the body. The at least one processor executes predetermined processing if the at least one processor determines that at least one of first illuminance detected by the first detector and second illuminance detected by the second detector changes.

18 Claims, 15 Drawing Sheets

(51) Int. Cl.

| | |
|---|---|
| ***G04G 19/12*** | (2006.01) |
| ***G04G 21/02*** | (2010.01) |
| ***G04G 21/06*** | (2010.01) |

(56) References Cited

U.S. PATENT DOCUMENTS

| | | | | |
|---|---|---|---|---|
| 2002/0159179 | A1 | 10/2002 | Nagai et al. | |
| 2008/0266118 | A1* | 10/2008 | Pierson ..... | A61B 5/0205 340/573.6 |
| 2016/0109861 | A1 | 4/2016 | Kim et al. | |
| 2017/0084133 | A1 | 3/2017 | Cardinali et al. | |

FOREIGN PATENT DOCUMENTS

| | | | |
|---|---|---|---|
| JP | H1152081 | A | 2/1999 |
| JP | 200069132 | A | 3/2000 |
| JP | 2001185748 | A | 7/2001 |
| JP | 2002278595 | A | 9/2002 |
| JP | 2002296376 | A | 10/2002 |
| JP | 2004363290 | A | 12/2004 |

* cited by examiner

ELECTRONIC DEVICE AND COMPUTER-READABLE NON-TRANSITORY RECORDING MEDIUM

CROSS-REFERENCE TO RELATED APPLICATION

The present application is a continuation of U.S. patent application Ser. No. 16/303,661, filed Nov. 21, 2018, which is a National Phase entry based on PCT Application No. PCT/JP2017/019569 filed on May 25, 2017, which claims the benefit of Japanese Application No. 2016-106068, filed on May 27, 2016, the disclosures of which are hereby incorporated by reference herein in their entirety.

FIELD

Embodiments of the present disclosure relate to electronic devices.

BACKGROUND

Conventionally, there are mobile communication devices generating electrical power upon receiving solar light.

SUMMARY

An electronic device according to one embodiment comprises a body and a band being able to attach the body to a part of a human body. The body comprises first and second detectors and at least one processor. The first detector detects illuminance on an upper surface of the body. The second detector is located in a position distant from a position of the first detector in a short-side direction of the band and detects the illuminance on the upper surface of the body. The at least one processor executes predetermined processing if the at least one processor determines that at least one of first illuminance detected by the first detector and second illuminance detected by the second detector changes.

A computer-readable non-transitory recording medium according to one embodiment is a computer-readable non-transitory recording medium storing a control program for controlling an electronic device. The electronic device comprises a body and a band being able to attach the body to a part of a human body. The body comprises first and second detectors. The first detector detects illuminance on an upper surface of the body. The second detector is located in a position distant from a position of the first detector in a short-side direction of the band and detects the illuminance on the upper surface of the body. The control program makes the electronic device execute predetermined processing if it is determined that at least one of first illuminance detected by the first detector and second illuminance detected by the second detector changes.

DETAILED DESCRIPTION

A plurality of embodiments for implementing an electronic device, a control method, and a control program are described in detail with reference to drawings. A smartwatch 1, which is a watch type device attached to a wrist, is described as one example of the electronic device hereinafter.

Figure 1:
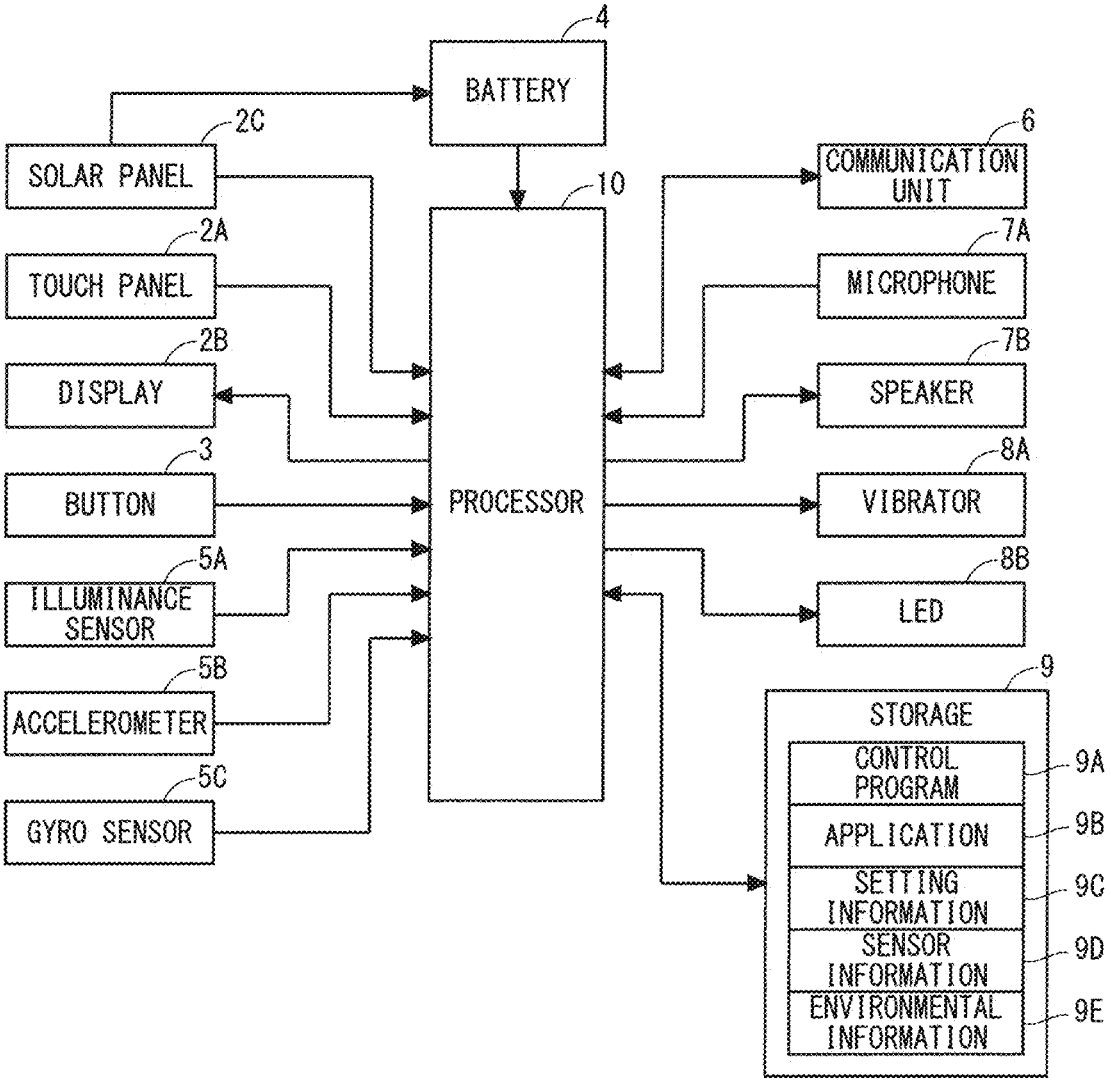
FIG. 1 illustrates a block diagram showing a function configuration of a smartwatch according to an embodiment.
Figure 2:
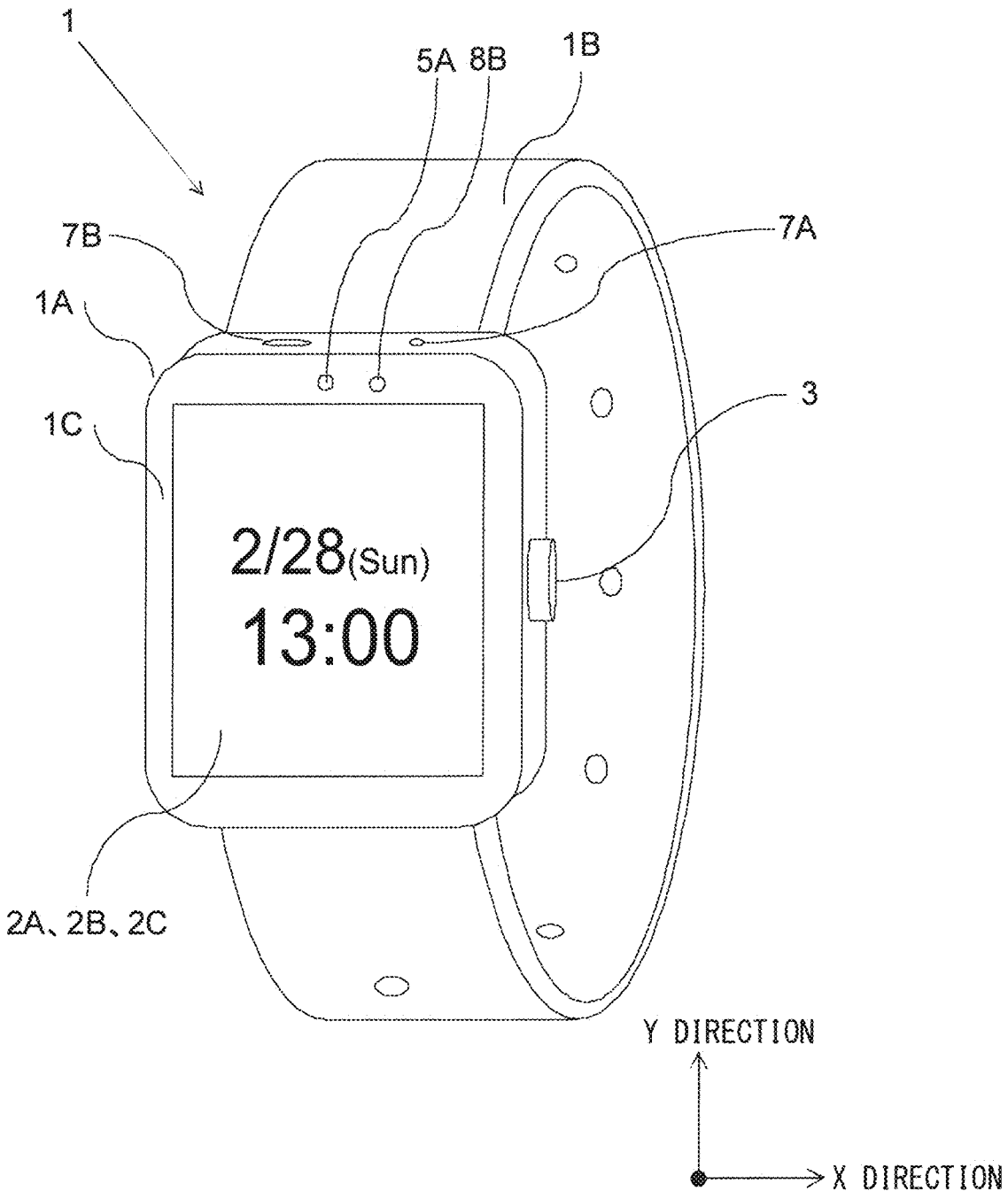
FIG. 2 illustrates an appearance diagram of the smartwatch according to an embodiment.

One example of a configuration of the smartwatch 1 is described with reference to FIGS. 1 and 2. FIG. 1 is a block diagram showing one example of the configuration of the smartwatch 1. FIG. 2 is an appearance diagram of one example of the smartwatch 1. The smartwatch 1 comprises a body 1A and a band 1B. The body 1A comprises a touch panel 2A, a display 2B, a solar panel 2C, a button 3, a battery 4, an illuminance sensor 5A, an accelerometer 5B, a gyro sensor 5C, a communication unit 6, a microphone 7A, a speaker 7B, a vibrator 8A, an LED 8B, a storage 9, and a processor 10. The band 1B is attached to a side surface of the body 1A.

Figure 3:
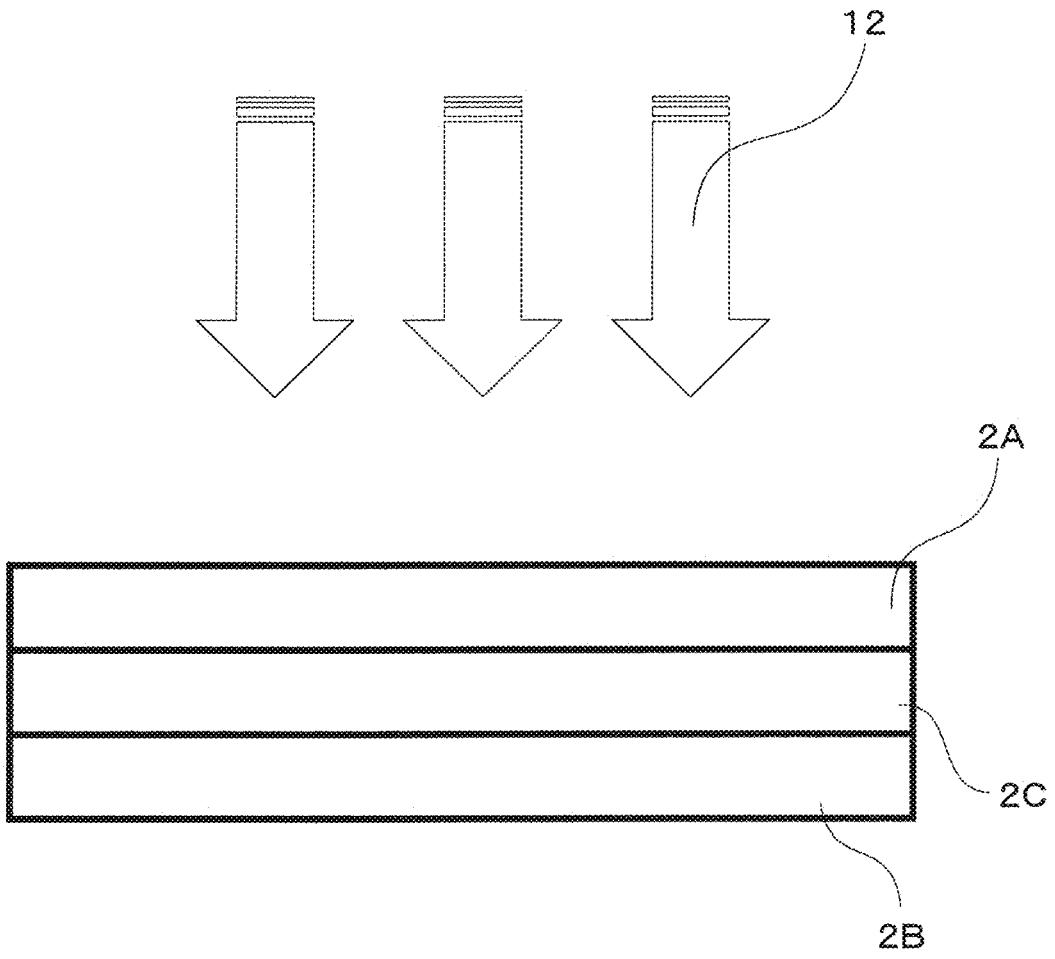
FIG. 3 illustrates a diagram showing a structure around a display and a touch panel according to an embodiment.

In the smartwatch 1 of one embodiment, the solar panel 2C is located between the touch panel 2A and the display 2B as shown in FIG. 3. The touch panel 2A, the display 2B, and the solar panel 2C are disposed on an upper surface of the smartwatch 1. However, the configuration of the smartwatch 1 is not necessarily limited to the present configuration. Each of the touch panel 2A and the display 2B may be provided on a surface different from the upper surface of the smartwatch 1. The smartwatch 1 may comprise a plurality of touch panels 2A and a plurality of displays 2B. The touch panel 2A and the display 2B may be an in-cell type display having both an input function and a display function.

A touch panel of electrostatic capacitance type, electromagnetic induction type, surface acoustic wave type, pressure sensitive type, liquid resistance film type, and infrared type, for example, is arbitrarily applied to the touch panel 2A. The touch panel 2A can detect a contact and proximity of a finger or an operator such as a stylus pen, for example.

Accordingly, the touch panel 2A can identify an operation performed by a user on the smartwatch 1 and transmit a signal corresponding to the identified operation to the processor 10.

The display 2B can display an image. The user can confirm a state of the smartwatch 1 by seeing the image displayed on the display 2B. A display device such as a liquid crystal display, an organic EL display, a non-organic EL display, or an electronic paper, for example, may be used for the display 2B. The display 2B may be a group of a large number of light-emitting elements instead of a single display device.

The solar panel 2C can generate electrical power upon absorbing light. The light absorbed by the solar panel 2C may be visible light (360 nm to 830 nm) visible to a human eye or may also be invisible light. If the solar panel 2C is placed on the touch panel 2A and the display 2B, the touch panel 2A and the solar panel 2C may be panels transmitting at least part of the visible light so that the display 2B can be visually recognized through the touch panel 2A and the solar panel 2C. According to the above configuration, when light 12 is emitted, the display 2B is irradiated with the light 12 through the touch panel 2A and the solar panel 2C, and part of the light 12 reflected by the display 2B is emitted outside through the solar panel 2C and the touch panel 2A. The emitted light enables the user of the smartwatch 1 to see the image displayed on the display 2B. If the display 2B is a liquid crystal display, the display 2B may comprise a backlight. If the backlight illuminates the display 2B, the light from the display 2B is emitted outside through the solar panel 2C and the touch panel 2A in the similar manner Also, if the display 2B is a self-luminous display such as an organic EL display, the light from the display 2B is emitted outside through the solar panel 2C and the touch panel 2A.

Figure 4:
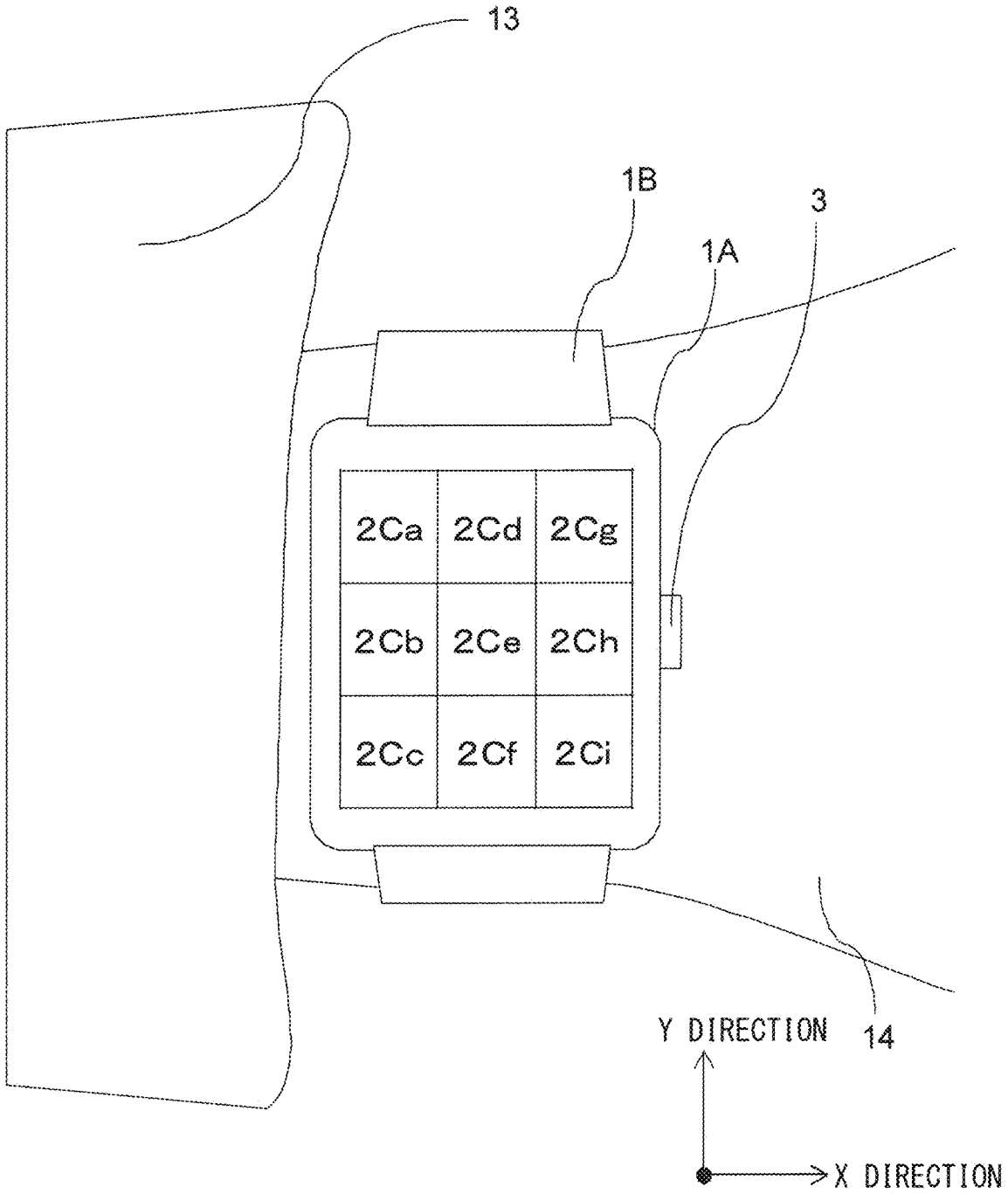
FIG. 4 illustrates a diagram showing one example of an arrangement of a solar panel of the smartwatch according to an embodiment.

The smartwatch 1 may comprise a plurality of solar panels 2C. In the smartwatch 1 according to one embodiment, nine solar panels 2C are placed on the display 2B as shown in FIG. 4. However, a total number of solar panels 2C needs not necessarily be nine. The number of solar panels 9C may be larger or smaller than nine. The solar panel 2C needs not necessarily be placed on the display 2B. For example, the solar panel 2C may be disposed on the band 1B or a bezel 1C, or may be disposed on another position. The solar panel 2C generates larger current as the emitted light gets strong, thus can be used as a detector detecting illuminance A power generation amount in the solar panel 2C is deemed to be the illuminance detected by the solar panel 2C.

FIG. 4 is a drawing for describing one example of an arrangement of the solar panel 2C. In FIG. 4, illustration of the illuminance sensor 5A, the microphone 7A, the speaker 7B, and the LED 8B, for example, shown in FIG. 2 is omitted. Also in FIG. 6 to FIG. 11, a configuration whose description is not particularly necessary is not shown but omitted.

The body 1A houses electronic components such as a sensor included in the smartwatch 1. The body 1A is formed of a resin in substantially a rectangular parallelepiped shape, for example. However, a shape and a material of the body 1A are not limited thereto. For example, the body 1A may have a discoid shape. A metal, a ceramic, or glass, for example, may be applied to the material of the body 1A, or a combination of these materials may also be applied.

In the present disclosure, the upper surface is a surface on which the touch panel 2A, the display 2B, and the solar panel 2C are disposed in the body 1A. The upper surface is not limited to a region where the touch panel 2A, the display 2B, and the solar panel 2C are disposed, however, the region may include the bezel 1C, for example. The upper surface needs not necessarily be a plane surface but may be curved. If the user wears the smartwatch 1 on his/her arm, the upper surface of the body 1A is exposed outside. Accordingly, the user can visually recognize information displayed on the display 2B disposed on the upper surface. The solar panel 2C is deemed to detect the illuminance on the upper surface of the body 1A.

The band 1B is attached to the body 1A. The band 1B can be curved to have a ring shape. The band 1B is used to wear the smartwatch 1 on the user's arm. The band 1B has a belt-like shape, and extends from a side surface of the body 1A of the smartwatch 1. The band 1B may be separated into two parts or may be made up of a single part. The body 1A of the smartwatch 1 may be fitted in the band 1B. The material of the band 1B may be a leather or a metal, or another material may also be applicable. The band 1B may be attachably/detachably mounted on the body 1A, and may be exchangeable. Various sensors or the battery 4, for example, may be provided in the band 1B. In this case, an additional function may be achieved in the smartwatch 1 by attaching the band 1B to the side surface of the body 1A of the smartwatch 1.

In the present disclosure, a longitudinal direction of the band 1B is a length direction of the band 1B, and indicates a direction in which the band 1B extends in a state where the band 1B is straightened. A short-side direction of the band 1B is a width direction of the band 1B, and indicates a direction perpendicular to the longitudinal direction. That is to say, the short-side direction is a direction in which the arm, to which the smartwatch 1 is attached, extends.

In the drawings, the longitudinal direction is a Y direction illustrated in FIG. 2 and FIG. 4, and the short-side direction is an X direction illustrated in FIG. 2 and FIG. 4, for example.

The band 1B needs not necessarily be a separated body attached to and detached from the body 1A, but may be integrated with the body 1A.

The button 3 is provided in the body 1A. When the button 3 is pressed, the button 3 can receive various inputs from the user. The button 3 receives, for example, an ON operation or an OFF operation of a power source on the smartwatch 1. The button 3 receives an operation of switching from an on state to an off state of the display 2B and an operation of switching from an off state to an on state of the display 2B. The button 3 receives a volume adjusting operation, for example. The button 3 may be either single or plural. The button 3 may be a physical key using a task switch or a membrane switch. The button 3 has a structure of detecting a contact and proximity of a finger or an operator such as a stylus pen, for example, using an electrostatic capacitance type sensor or a pressure sensitive type sensor. The button 3 may be a soft key provided by using part of the touch panel 2A.

The battery 4 can supply electrical power to each component of the smartwatch 1. The smartwatch 1 of one embodiment can use the electrical power generated by the solar panel 2C for charging the battery 4.

The illuminance sensor 5A is located on the upper surface of the smartwatch 1. The illuminance sensor 5A can detect illuminance around the illuminance sensor 5A. Particularly, the illuminance sensor 5A can detect the illuminance on the upper surface of the smartwatch 1. The illuminance sensor 5A is used for controlling brightness of the display 2B. The illuminance is intensity, brightness, and luminance of the light, for example. If the illuminance detected by the illuminance sensor 5A is large, the processor 10 sets the display 2B bright to increase the visibility of the display 2B. The illuminance sensor 5A may comprise a function of a proximity sensor for detecting proximity of an object to the illuminance sensor 5A.

The illuminance sensor 5A comprises a photodiode. Since the photodiode generates larger current as it is irradiated with the stronger light, the illuminance sensor 5A can be used as a detector of detecting the illuminance The processor 10 can calculate the illuminance based on a current value generated by the photodiode of the illuminance sensor 5A. The smartwatch 1 may comprise a plurality of illuminance sensors.

The accelerometer 5B can detect a direction and a magnitude of acceleration acting on the smartwatch 1.

The gyro sensor 5C can detect an angular speed of the smartwatch 1.

The processor 10 can detect a change in a posture of the body 1A of the smartwatch 1 based on a signal of the accelerometer 5B or the gyro sensor 5C.

The communication unit 6 comprises a circuit to convert a signal for communication and an antenna to transmit and receive the signal. A communication standard used by the communication unit 6 is a wireless communication, for example. The communication standard includes, for example, 2G, 3G, LTE (Long Term Evolution), 4G, WiMAX (R) (Worldwide Interoperability for Microwave Access), Bluetooth (R), IEEE 802.11, NFC (Near Field Communication), IrDA (Infrared Data Association), and Zigbee (R). The communication standard is not limited thereto, however, various wireless communication systems are included.

The communication unit 6 can use Internet communication, thereby obtaining various types of information including weather information and date and time information. If the communication unit 6 can communicate with a base station by the system of 2G, 3G, and LTE, for example, the smartwatch 1 can estimate positional information based on the base station to which the communication unit 6 is connected. If the smartwatch 1 can communicate with the other communication device such as a smartphone which can communicate with the base station, the smartwatch 1 can estimate the positional information from the information of the base station in the similar manner.

The microphone 7A can receive an input of sound. The microphone 7A can convert a voice of the user and a surrounding environmental sound, for example, into a sound signal. A total number of the microphones 7A is not limited to one, however, a plurality of microphones 7A may also be applicable.

The speaker 7B can output sound. The speaker 7B can output an audio of a video, a music, and an alarm sound, for example. The speaker 7B can also output a voice of a call during a hands-free call.

The vibrator 8A comprises an eccentric motor or a piezoelectric element, for example. The vibrator 8A vibrates the smartwatch 1, thereby being able to transmit a notification to the user, for example.

The LED 8B emits the light, thereby being able to transmit a notification to the user, for example.

The storage 9 is made up of a storage medium such as a flash memory, an HDD, a SSD, a memory card, an optical disk, a magnetic optical disk, or a RAM, or a combination of the storage medium, for example. The storage 9 can store a program and data. The storage 9 may include a storage medium and a reading device to read out information from the storage medium.

The program stored in the storage 9 includes a control program 9A which controls an operation of the smartwatch 1 and an application program 9B (referred to as the "application 9B" hereinafter). The control program 9A includes OS, for example. The application 9B is executed in a foreground when an input to an icon corresponding to the application 9B is received, and the display 2B displays a screen which enables an operation on the application 9B. The application 9B may also be executed in a background. The application 9B includes various applications such as an application pre-installed in the smartwatch 1 and an application installed by the user. The storage 9 stores various types of setting information 9C, sensor information 9D including history information of signals transmitted from the various sensors, a result determined from the sensor information 9D, and environmental information 9E obtained from Internet communication, for example.

The processor 10 is one example of a controller. The smartwatch 1 comprises at least one processor 10 and provides a control and a processing capacity to achieve various functions described below. In accordance with various embodiments, the at least one processor 10 may be implemented as a single integrated circuit (IC) or as multiple communicatively coupled IC's and/or discrete circuits. The at least one processor 10 can be achieved by various known techniques. In one embodiment, the processor 10 comprises one or more circuits or units configured to perform one or more data computing procedures or processes by executing instructions stored in an associated memory, for example. In the other embodiment, the processor 10 may be firmware configured to execute one or more data computing procedures or processes (a discrete logic component, for example). In accordance with various embodiments, the processor 10 may comprise one or more processors, controllers, microprocessors, microcontrollers, application specific integrated circuits (ASICs), digital signal processors, programmable logic devices, field programmable gate arrays, or any combination of these devices or structures, or other known devices and structures, to perform the functions described hereinafter.

The processor 10 may comprise a determination unit and a hand-off unit. In some embodiments, the determination unit and the hand-off unit are achieved as executable commands stored in the memory, and a processing circuit included in the processor 10 executes the commands. The determination unit and the hand-off unit execute each process described in the present disclosure. In another embodiment, at least one of the determination unit and the hand-off unit may be achieved by a separate IC's or a discrete circuit communicatively coupled to the processor 10 to achieve each function described in the present disclosure.

The processor 10 executes the application 9B and the control program 9A. The processor 10 totally controls the operation of the smartwatch 1 to achieve the various functions.

The smartwatch 1 may comprise a GPS (Global Positioning System) receiver in addition to the above function units. The processor 10 can use a signal from a GPS satellite received by the GPS receiver to detect a current position of the smartwatch 1. The smartwatch 1 may further comprise an atmospheric pressure sensor for measuring an atmospheric pressure and an azimuth sensor for measuring an azimuth direction.

<First Embodiment>

As shown in FIG. 4, the smartwatch 1 of one embodiment comprises a solar panel group. The solar panel group is a group of the plurality of solar panels 2C placed on the display 2B and disposed to cover the display 2B. If a sleeve 13 of a cloth of the user covers part of the solar panel group, the processor 10 included in the smartwatch 1 according to one embodiment changes the display 2B from the on state to the off state. If the sleeve 13 is removed from over the solar panel group, the processor 10 changes the display 2B from the off state to the on state. Thus, when the user does not see the display 2B, the display 2B is in the off state, and when the user removes the sleeve 13 of the cloth from over the display 2B to see the display 2B, the display 2B enters the on state.

According to the operation described above, the smartwatch 1 according to one embodiment can reduce a consumed power by changing the state of the display 2B to the off state in the state where the sleeve 13 of the cloth covers at least the part of the display 2B, that is to say, in the state where it is assumed that the user does not see the display 2B.

If the user removes the sleeve 13 of the cloth covering the display 2B from over the display 2B to see the display 2B, the display 2B of the smartwatch 1 enters the on state without requiring the operation on the smartwatch 1. Accordingly, operability of the smartwatch 1 is improved.

The above processing is described in more detail hereinafter.

In the description in one embodiment, the solar panel group has nine solar panels 2Ca to 2Ci as shown in FIG. 4. The smartwatch 1 is attached to a left hand 14 of the user as shown in FIG. 4, for example. As shown in FIG. 4, when the upper surface of the smartwatch 1 is seen from a front surface, the nine solar panels 2C include a solar panel 2Ca disposed in an upper row in a first column on a left side, a solar panel 2Cb disposed in a middle row in the first column, and a solar panel 2Cc disposed in a lower row in the first column. The nine solar panels 2C include a solar panel 2Cd disposed in an upper row in a second column on a middle side, a solar panel 2Ce disposed in a middle row in the second column, and a solar panel 2Cf disposed in a lower row in the second column. The nine solar panels 2C include a solar panel 2Cg disposed in an upper row in a third column on a right side, a solar panel 2Ch disposed in a middle row in the third column, and a solar panel 2Ci disposed in a lower row in the third column.

In the present disclosure, "the solar panel 2C" indicates one of the solar panels 2Ca to 2Ci in a case where the solar panels 2Ca to 2Ci are not distinguished from each other.

When each solar panel 2C is irradiated with the light, each solar panel 2C generates electrical power by a photovoltaic effect. It is assumed that a region where the solar panel 2C, which is generating the electrical power, is disposed in the upper surface of the body 1A including the solar panel group is irradiated with the strong light. It is assumed that a region where the solar panel 2C, which is not generating the electrical power, is disposed in the upper surface of the body 1A is irradiated with the weak light or no light is emitted to the region. If there is the solar panel 2C which is not generating the electrical power in the upper surface of the body 1A on which the solar panel 2C is disposed, there is a possibility that the solar panel 2C is covered by an object which blocks the light. In the case of the smartwatch 1 in one embodiment, the sleeve 13 of the cloth which the user wears is considered as one example of the object which blocks the light.

When the solar panel 2C is covered by the object blocking the light such as the sleeve 13, the display 2B disposed to overlap with the solar panel 2C is also covered by the object blocking the light in the similar manner Accordingly, when the solar panel 2C is covered by the object blocking the light such as the sleeve 13, the user is in a state where the user cannot visually recognize or has difficulty visually recognizing at least part of the display 2B. When such a state is continued, there is a lower possibility that the user sees the display 2B.

The processor 10 included in the smartwatch 1 according to one embodiment executes processing of changing the display 2B from the on state to the off state or from the off state to the on state in accordance with whether or not the solar panels 2Ca, 2Cb, and 2Cc belonging to the first column generate the electrical power in the nine solar panels 2C, for example. The expression of "not generate the electrical power" in the present disclosure also indicates a state where the power generation amount is smaller than a threshold value and the solar panel 2C hardly generates the electrical power.

It is applicable that the processing of changing the display 2B from the on state to the off state and from the off state to the on state is executed not only in accordance with whether or not the solar panels 2Ca, 2Cb, and 2Cc belonging to the first column generate the electrical power but also in accordance with a comparison result between a power generation amount in the solar panels 2Ca, 2Cb, and 2Cc belonging to the first column and a power generation amount in the solar panels 2Cg, 2Ch, and 2Ci belonging to the third column.

Described firstly is the processing of changing the display 2B from the on state to the off state performed by the processor 10 included in the smartwatch 1.

When the solar panels 2Ca, 2Cb, and 2Cc belonging to the first column do not generate the electrical power and at least one of the solar panels 2Cd, 2Ce, 2Cf, 2Cg, 2Ch, and 2Ci belonging to the second column and the third column generates the electrical power, it is considered that at least part of the region including the solar panels 2Ca, 2Cb, and 2Cc belonging to the first column is not irradiated with the light even though it is bright around the smartwatch 1.

When the smartwatch 1 is attached to the left hand 14 of the user, there is a high possibility that the sleeve 13 of the cloth of the user covers the solar panels 2Ca, 2Cb, and 2Cc belonging to the first column.

In a similar manner, there is a high possibility that the region in the display 2B on which the solar panels 2Aa, 2Cb, and 2Cc belonging to the first column are placed is covered by the sleeve 13 of the cloth. There is a low possibility that the user sees the display 2B in a state where the whole display 2B is not seen.

Accordingly, in such a case, the processor 10 may change the display 2B from the on state to the off state.

For example, the processor 10 determines whether or not the solar panel 2C generates the electrical power in accordance with whether or not the power generation amount obtained in a predetermined period of time in the solar panel 2C exceeds a threshold value. Accordingly, the processor 10 can determine, for each solar panel 2C, whether or not the solar panel 2C generates the electrical power. If the processor 10 determines whether or not the solar panels 2Ca, 2Cb, and 2Cc belonging to the first column generate the electrical power, the processor 10 may determine whether or not the solar panels 2Ca, 2Cb, and 2Cc belonging to the first column generate the electrical power not by separately determining whether or not each of the solar panels 2Ca, 2Cb, and 2Cc generates the electrical power but based on a difference between a total power generation amount in the solar panels 2Ca, 2Cb, and 2Cc belonging to the first column and a total power generation amount in the solar panels 2Cg, 2Ch, and 2Ci belonging to the third column. Alternatively, the processor 10 may determine whether or not the solar panels 2Ca, 2Cb, and 2Cc belonging to the first column generate the electrical power based on a difference between a maximum power generation amount in the power generation amount in the solar panels 2Ca, 2Cb, and 2Cc belonging to the first column obtained in a predetermined period of time and a maximum power generation amount in the power generation amount in the solar panels 2Cg, 2Ch, and 2Cci belonging to the third column obtained in a predetermined period of time. Alternatively, the processor 10 may determine whether or not the solar panels 2Ca, 2Cb, and 2Cc belonging to the first column generate the electrical power based on an average current value in the solar panels 2Ca, 2Cb, and 2Cc belonging to the first column in a predetermined period of time, for example.

The smartwatch 1 has a function of changing the display 2B from the off state to the on state to display information on the display 2B as a means of transmitting a notification to the user. However, if it is assumed that the user does not see the display 2B as described above, it is also applicable that the smartwatch 1 does not change the display 2B from the on state to the off state but maintains the off state of the display 2B.

As described above, the smartwatch 1 in one embodiment, in the state of being attached to the left hand 14 of the user, executes the processing of changing the display 2B from the on state to the off state when any one of the solar panels 2Cd, 2Ce, 2Cf, 2Cg, 2Ch, and 2Ci belonging to the second column and the third column in the nine solar panels 2*c* generates the electrical power and none of the solar panels 2Ca, 2Cb, and 2Cc belonging to the first column generates the electrical power.

Described next is the processing of changing the display 2B from the off state to the on state performed by the processor 10.

For example, when the solar panels 2Ca, 2Cb, and 2Cc belonging to the first column and the solar panels 2Cg, 2Ch, and 2Ci belonging to the third column generate the electrical power, it is considered that the display 2B and the solar panel 2C are not covered by the sleeve 13 of the cloth.

Accordingly, in such a case, the processor 10 may change the display 2B from the off state to the on state.

Particularly, when a first state where the solar panels 2Ca, 2Cb, and 2Cc belonging to the first column do not generates the electrical power and any of the solar panels 2Cd, 2Ce, 2Cf, 2Cg, 2Ch, and 2Ci belonging to the second column and the third column generates the electrical power changes to a second state where the solar panels 2Ca, 2Cb, and 2Cc belonging to the first column generate the electrical power, there is a high possibility that the sleeve 13 of the cloth of the user is removed from over the solar panel 2C. Accordingly, when the first state changes to the second state, the processor 10 may change the display 2B from the off state to the on state.

According to the processing described above, when the sleeve 13 is removed from over the solar panel 2C, the display 2B changes from the off state to the on state, thus the user can use the smartwatch 1 immediately.

It is also applicable that the power generation amount in the solar panels 2Ca, 2Cb, and 2Cc belonging to the first column and the power generation amount in the solar panels 2Cg, 2Ch, and 2Ci belonging to the third column are compared, and only when both power generation amounts are substantially the same (for example, smaller than 10%), the processor 10 changes the display 2B from the off state to the on state. In this case, the processing is executed only when the whole solar panel 2C is completely exposed, thus the possibility of an occurrence of malfunction is reduced.

Figure 6:
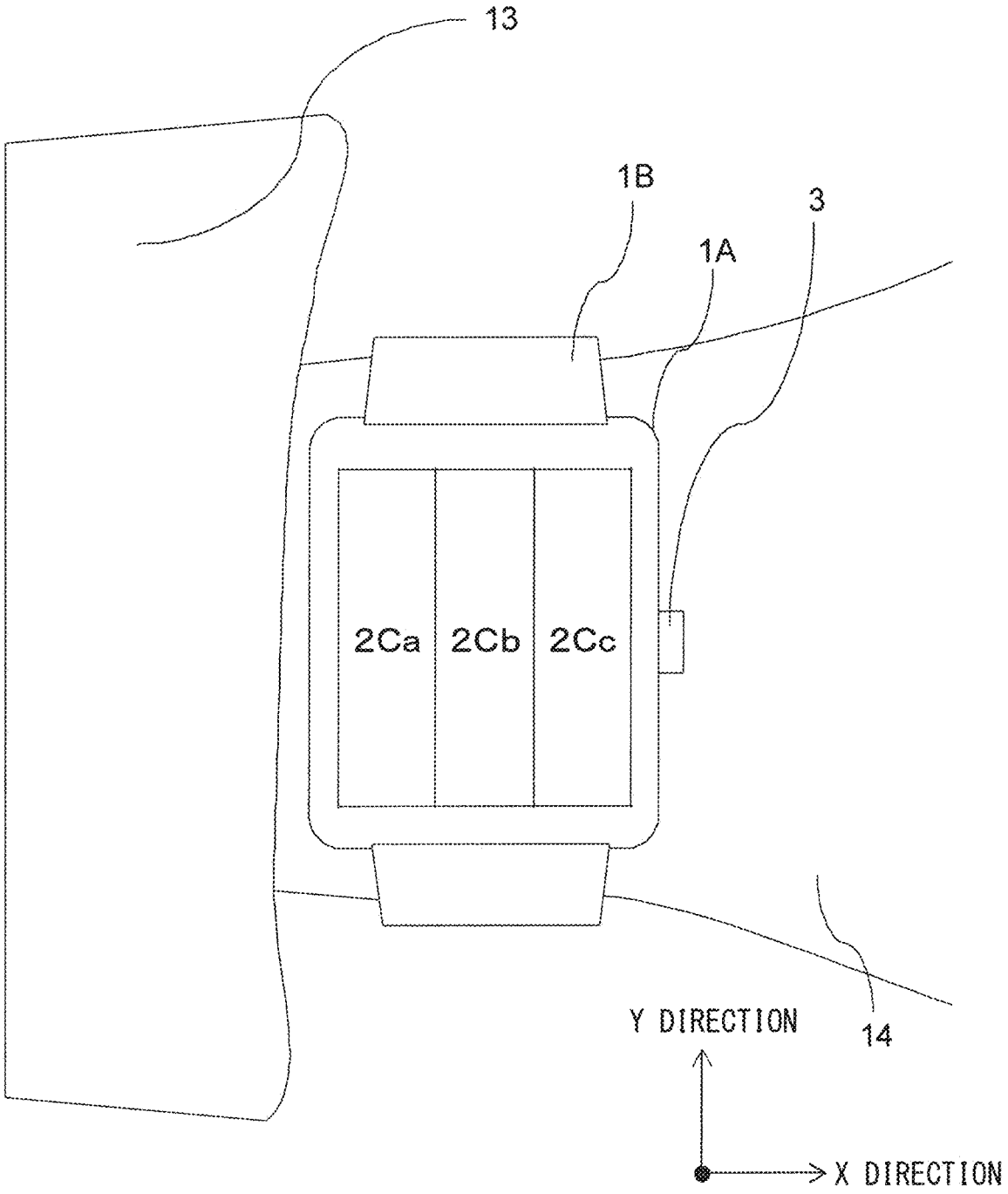
FIG. 6 illustrates a diagram showing one example of an arrangement of a solar panel of the smartwatch according to an embodiment.

Although the case where the number of the solar panels 2C is nine in the processing described above, a different number may also be applicable. For example, the number of the solar panels 2C may be three as shown in FIG. 6. In this case, the processor 10 may measure the power generation amount on the solar panel 2Ca belonging the position of the first column and the solar panel 2Cc belonging to the position of the third column.

Figure 7:
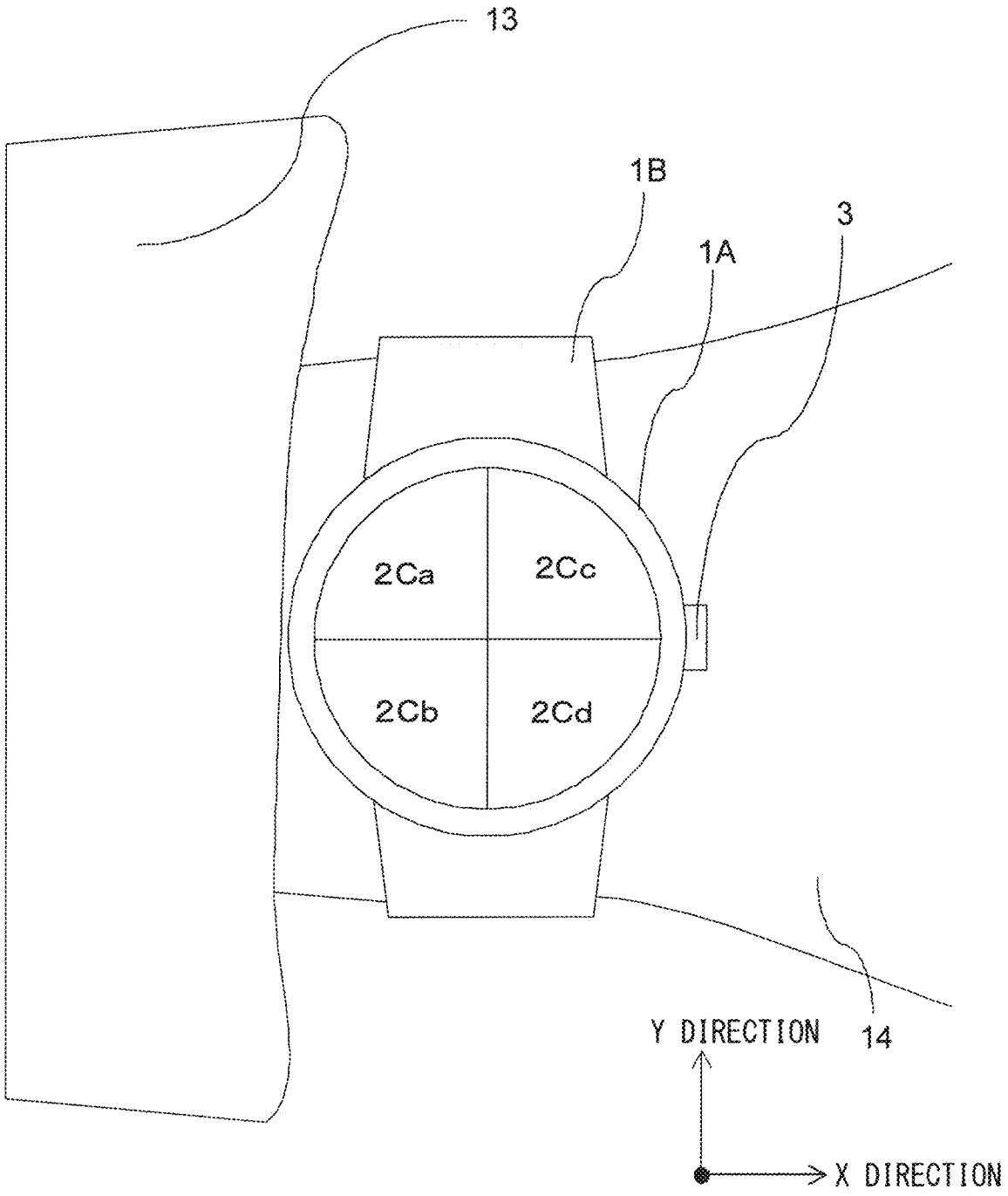
FIG. 7 illustrates a diagram showing one example of an arrangement of a solar panel of the smartwatch according to an embodiment.
Figure 8:
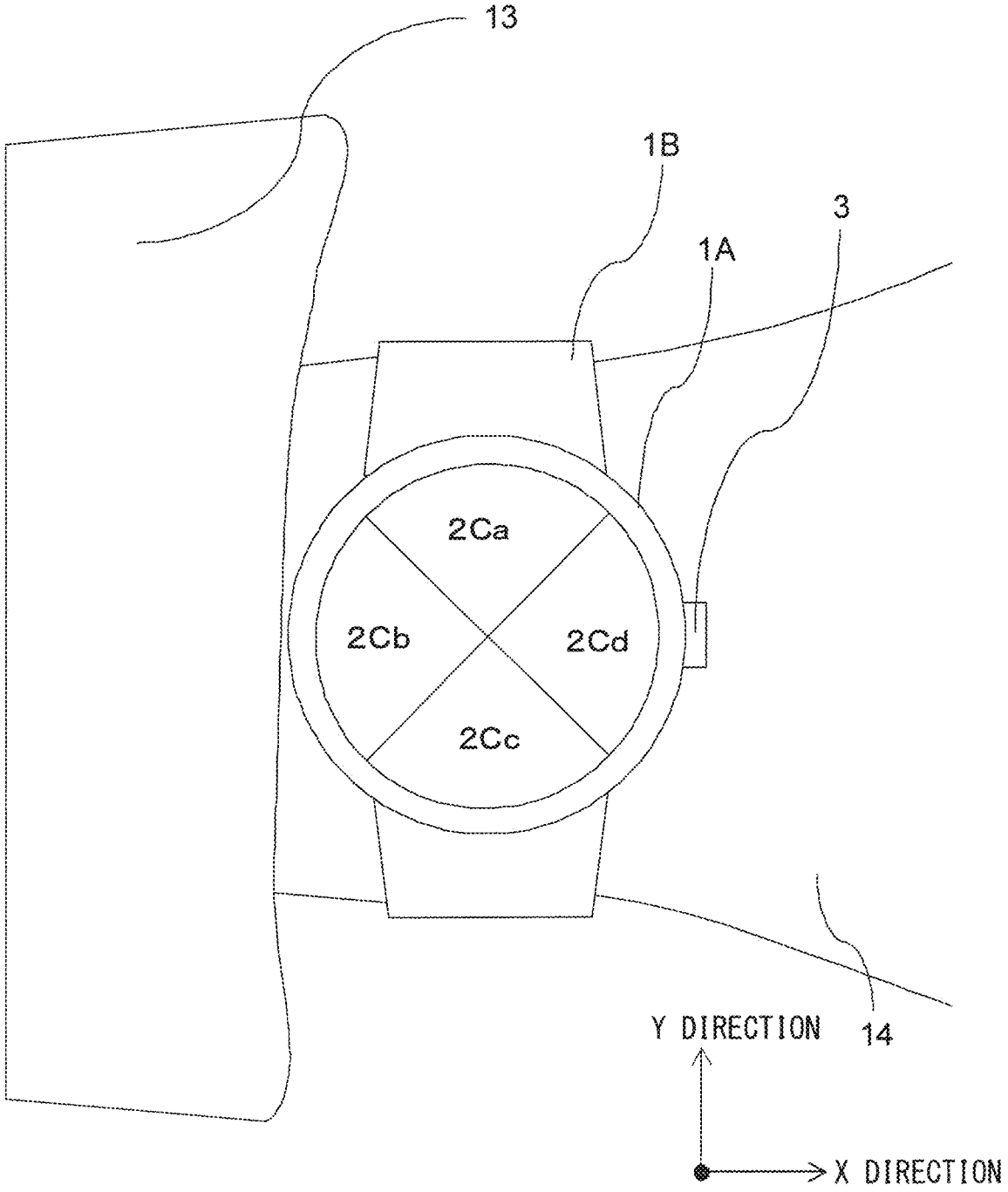
FIG. 8 illustrates a diagram showing one example of an arrangement of a solar panel of the smartwatch according to an embodiment.
Figure 9:
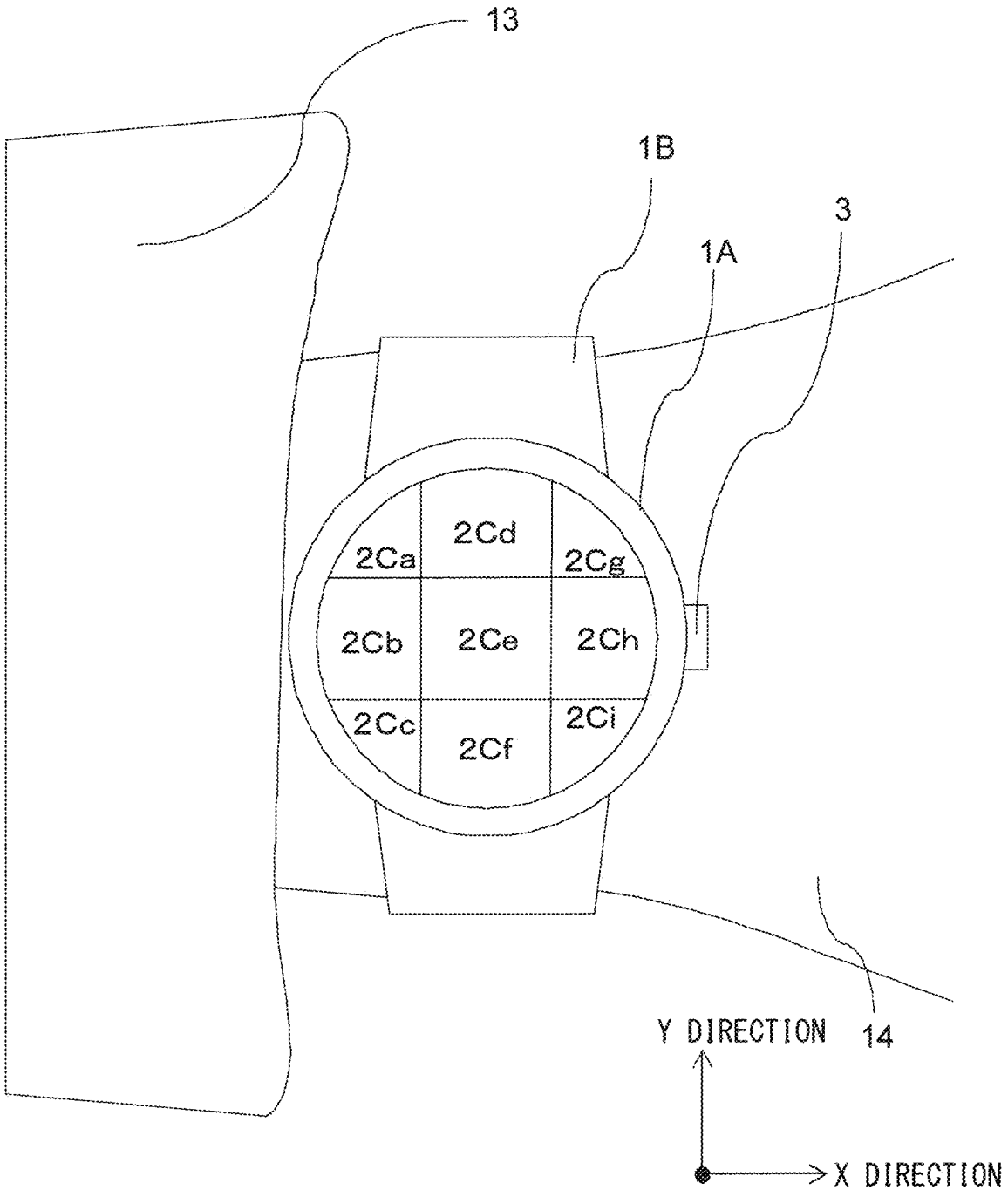
FIG. 9 illustrates a diagram showing one example of an arrangement of a solar panel of the smartwatch according to an embodiment.

It is also applicable that the solar panel 2C is not disposed on the rectangular display 2B but disposed on a circular display 2B as shown in FIG. 7, FIG. 8, and FIG. 9.

If the solar panel 2C is disposed on the circular display 2B, four solar panels 2C each having a fan-like shape may be provided as shown in FIG. 7 and FIG. 8, for example. According to the arrangement shown in FIG. 7 and FIG. 8, the plurality of solar panel 2C have the same area, thus the illuminance calculated from the power generation amount can be easily compared. In the case of the arrangement shown in FIG. 7, the power generation amount in the solar panel 2Ca and the solar panel 2Cb located on a left side of a paper sheet is measured as the solar panel belonging to the first column in FIG. 4, and the power generation amount in the solar panel 2Cc and the solar panel 2Cd located on a right side of the paper sheet is measured as the solar panel belonging to the third column in FIG. 4. In the case of FIG. 8, the power generation amount in the solar panel 2Cb located on the left side of the paper sheet and the power generation amount in the solar panel 2Cd located on the right side of the paper sheet may be measured as the solar panel belonging to the first column in FIG. 4 and the solar panel belonging to the third column in FIG. 4, respectively.

The arrangement of the plurality of solar panels 2C may be similar to the arrangement shown in FIG. 9. However, the areas of the plurality of solar panels 2C are not identical with each other in the arrangement in FIG. 9, so that even if the plurality of solar panels 2C receive the light of the same illuminance, the power generation amounts of the plurality of solar panels 2C are considered to be different from each other. Accordingly, in comparing the power generation amount, an evaluation needs to be performed in consideration of the area of each solar panel 2C.

Figure 10:
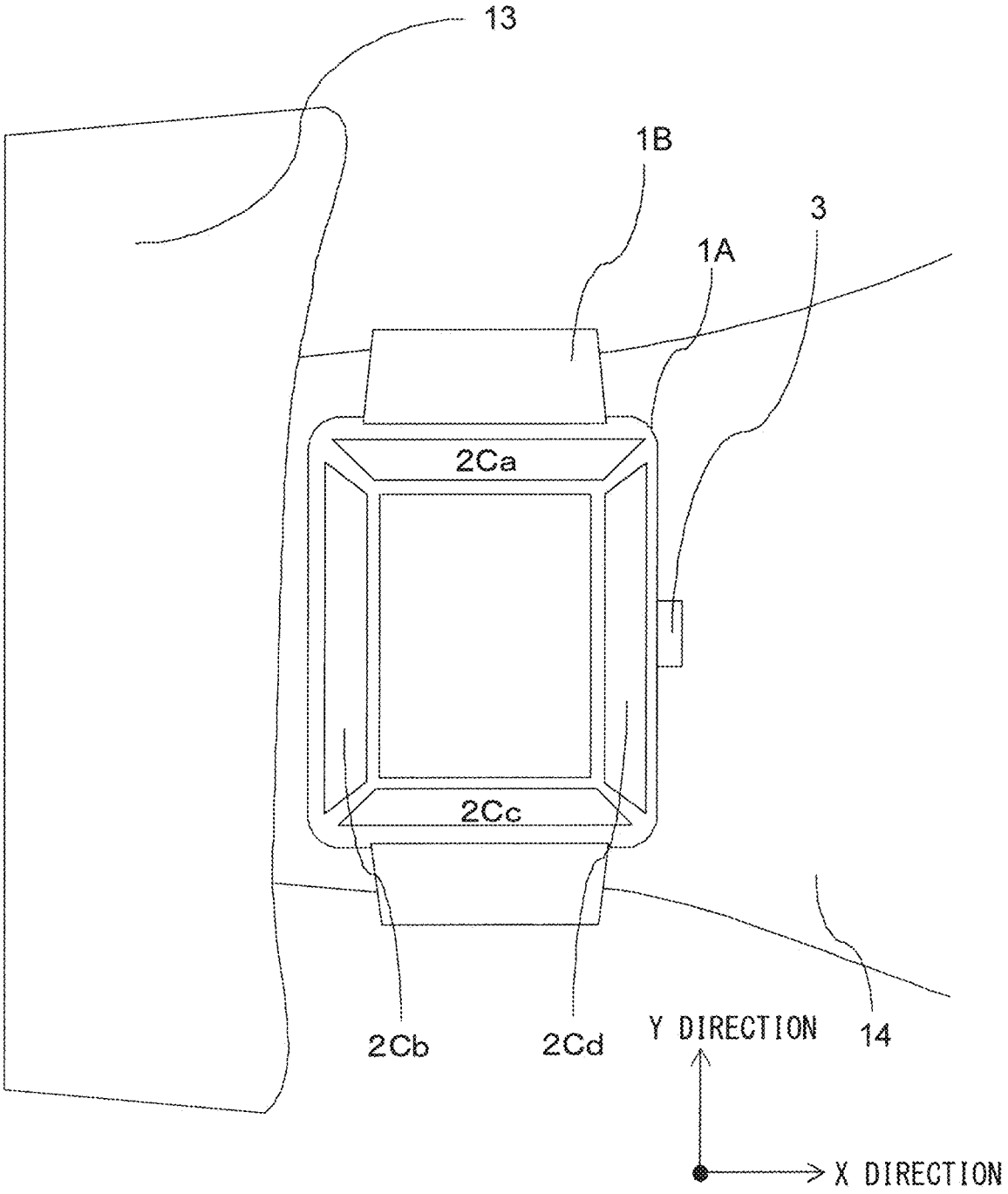
FIG. 10 illustrates a diagram showing one example of an arrangement of a solar panel of the smartwatch according to an embodiment.

The arrangement of the plurality of solar panels 2C may be similar to the arrangement shown in FIG. 10. In the arrangement in FIG. 10, each solar panel 2C is not placed on the display 2B but disposed around the display 2B. Also in this case, the power generation amount in the solar panel 2Cb located on the left side of the paper sheet and the power generation amount in the solar panel 2Cd located on the right side of the paper sheet may be measured as the solar panel belonging to the first column in FIG. 4 and the solar panel belonging to the third column in FIG. 4, respectively.

Figure 11:
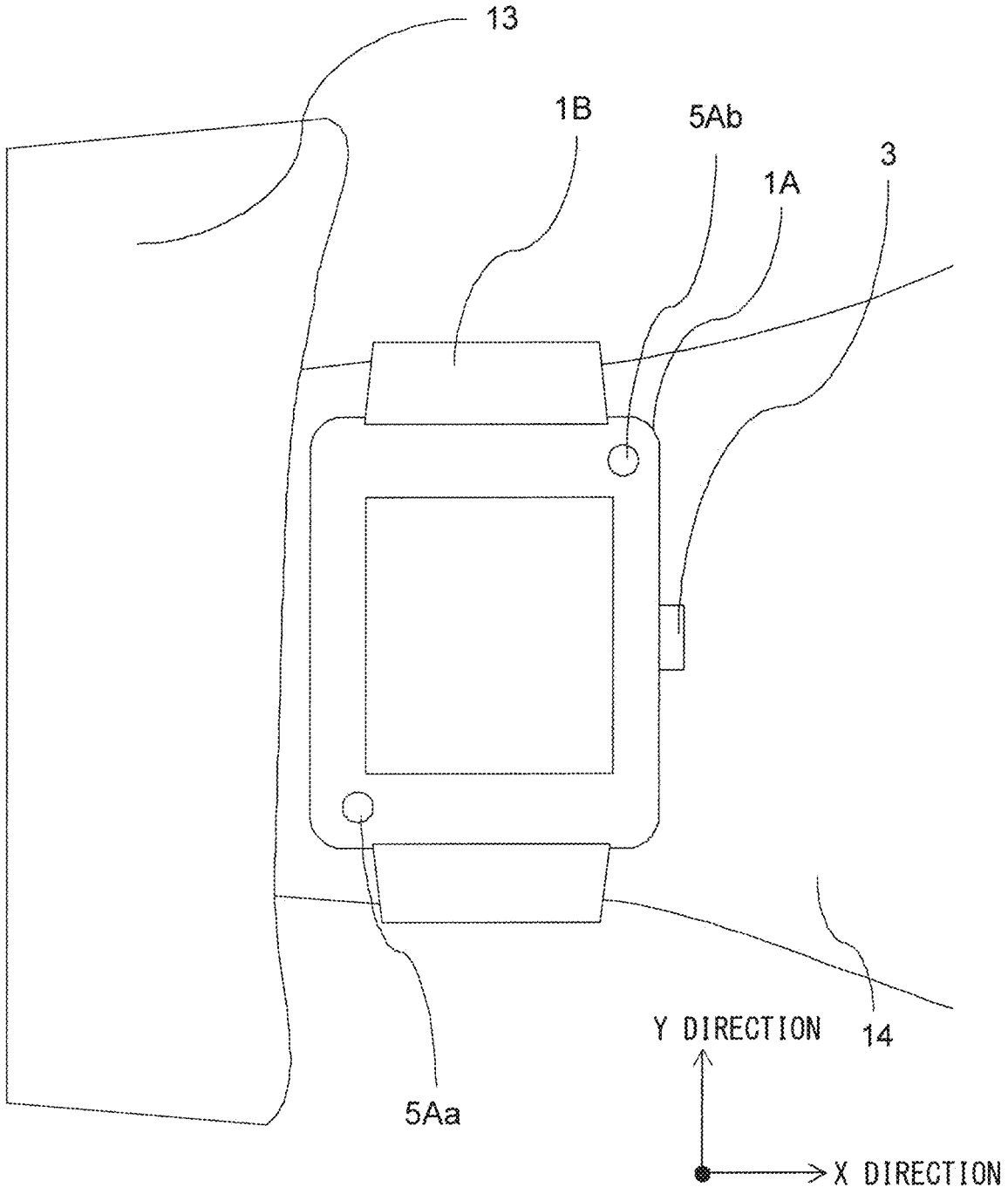
FIG. 11 illustrates a diagram showing one example of an arrangement of an illuminance sensor of the smartwatch according to an embodiment.

A means of detecting the light is not necessarily limited to the solar panel 2C. For example, as shown in FIG. 11, illuminance sensors 5Aa and 5Ab may be provided instead of the solar panel 2C. The illuminance sensors 5Aa and 5Ab are located in regions on a left side and right side of a paper sheet of FIG. 11, respectively.

The processor 10 uses the plurality of illuminance sensors 5Aa and 5Ab, thereby being able to estimate whether there is an object blocking the light to the smartwatch 1 or to what extent the smartwatch 1 is covered. In the example in FIG. 11, the smartwatch 1 comprises the illuminance sensor 5Aa and the illuminance sensor 5Ab, however, the smartwatch 1 may comprise a larger number of illuminance sensors.

The processor 10 may perform control with a combination of the illuminance sensor 5A and the solar panel 2C. For example, if the smartwatch 1 is attached to the left hand 14 of the user, the processor 10 may determine whether or not a part corresponding to the solar panel 2C in the first column in FIG. 1 is covered by the sleeve 13 of the cloth of the user using the illuminance sensor 5A instead of the solar panel 2C, and determine whether or not a part corresponding to the solar panel 2C in the third column in FIG. 4 is covered by the sleeve 13 of the cloth of the user using the solar panel 2C in the third column in FIG. 4. In this case, the illuminance sensor 5A can be provided in a part of the upper surface of the body 1A on which the determination whether or not the part is covered by the sleeve 13 is desired to be performed.

If the smartwatch 1 comprises a means capable of determining the region where the electrical power is generated and the region where the electrical power is not generated in the solar panel 2C, the smartwatch 1 can implement the present disclosure using the means. It is also applicable that not the plurality of solar panels 2C or illuminance sensors 5A but the single solar panel 2C is used. For example, if it is detected that the electrical power is generated only in the region on the right side of the paper sheet in FIG. 2 in the single solar panel 2C, the processor 10 may change the display 2B from the on state to the off state.

If the finger or the operator such as the stylus pen gets close to the touch panel 2A, there is a possibility that the operator blocks the light 12 to the solar panel 2C. At this time, it is applicable that in order to suppress the activation of the function of changing the screen to the off state in accordance with the change in the power generation amount in the solar panel 2C, the processor 10 suspends the execution of the function until a predetermined period of time (for example, one second) passes, and does not change the display 2B from the on state to the off state but maintains the off state of the display 2B upon receiving the input operation to the touch panel 2A during the suspension.

Figure 5:
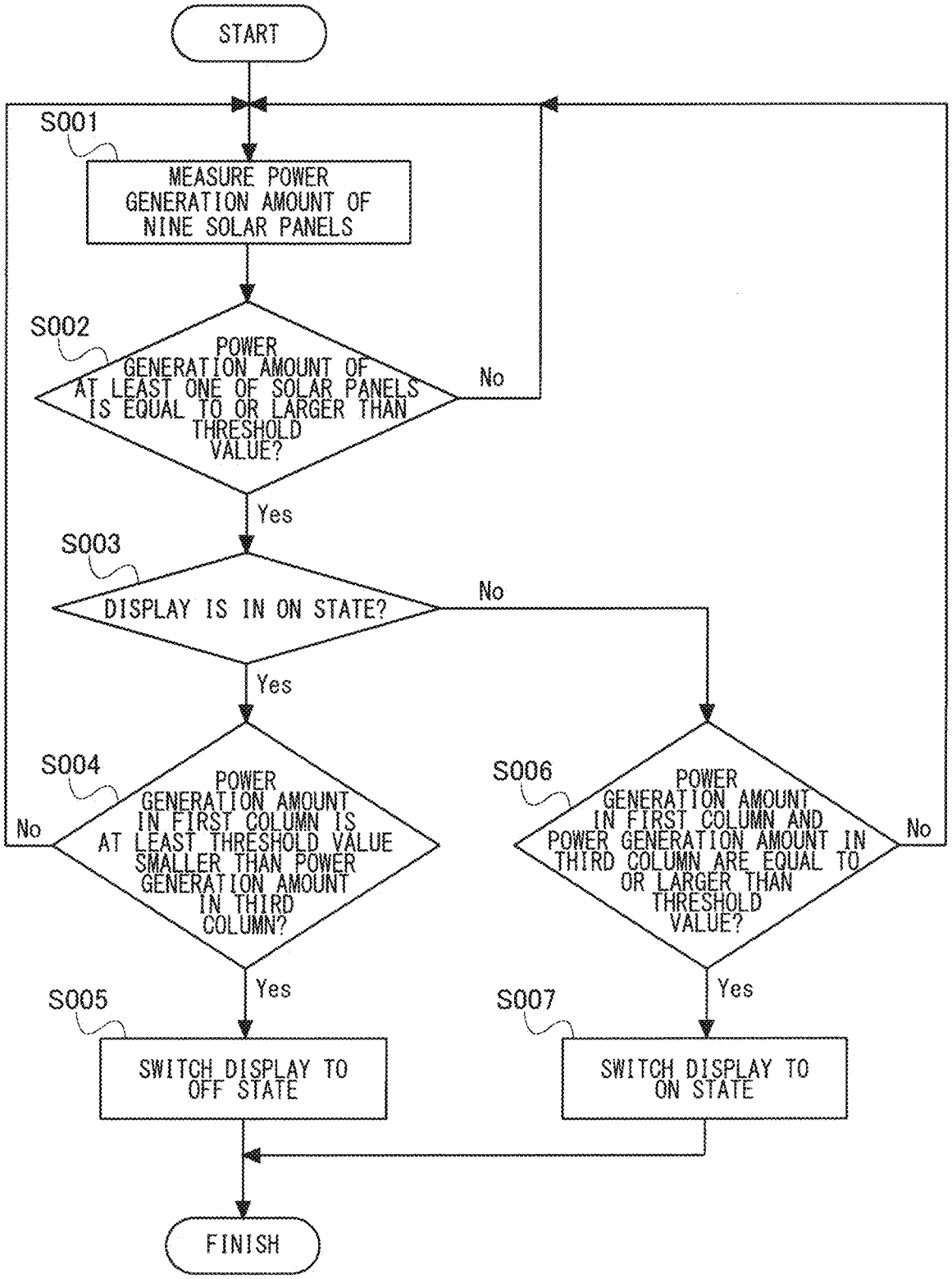
FIG. 5 illustrates a flow chart showing one example of a flow of processing according to an embodiment.

FIG. 5 is a flow chart showing one example of the processing executed in the smartwatch 1.

The processor 10 included in the smartwatch 1 shown in FIG. 4 measures the power generation amount in each of the solar panels 2Ca to 2Ci in Step S001.

Next, in Step S002, the processor 10 determines whether the power generation amount in any of the solar panel 2C exceeds a threshold value from the power generation amount obtained in Step S001. If the power generation amount in any of the solar panels 2C exceeds the threshold value, the processor 10 proceeds with the processing to Step S003. If no power generation amount in all of the solar panels 2C exceeds the threshold value, the processor 10 returns the processing to Step S001 by reason that it cannot be determined whether all of the solar panels 2C are covered by an object blocking the light or whether it is dark around the smartwatch 1, thus each solar panel 2C cannot generate the electrical power.

The processor 10 determines whether or not the display 2B is in the on state in Step S003. If the display 2B is in the on state, the processor 10 proceeds with the processing to Step S004.

The processor 10 obtains the power generation amount in the first column and the power generation amount in the third column based on information obtained in Step S001 to compare those power generation amounts in Step S004. The power generation amount in the first column may be a maximum power generation amount in the power generation amounts of the solar panels 2Ca, 2Cb, and 2Cc, belonging to the first column or may also be a total power generation amount in the solar panels 2Ca, 2Cb, and 2Cc. In a similar manner, the power generation amount in the third column may be a maximum power generation amount in the power generation amounts of the solar panels 2Cg, 2Ch, and 2Ci belonging to the third column, or may also be a total power generation amount in the solar panels 2Cg, 2Ch, and 2Ci. If the power generation amount in the first column is smaller than the power generation amount in the third column and a difference between those power generation amounts is equal to or larger than a threshold value as a result of the comparison, it is deemed that there is a high possibility that the region around the first column is covered by the object blocking the light in the display 2B even though the smartwatch 1 is in an environment with brightness sufficient to generate the electrical power. Accordingly, if the power generation amount in the first column is smaller than the power generation amount in the third column and the difference between those power generation amounts is equal to or larger than the threshold value, the processor 10 changes the display 2B to the off state in Step S005.

In the meanwhile, if the display 2B is in the off state in Step S003, the processor 10 proceeds with the processing to Step S006.

The processor 10 obtains the power generation amount in the first column and the power generation amount in the third column based on the information obtained in Step S001 to determine whether or not each of the power generation amounts is equal to or larger than the threshold value in Step S006. If each of the power generation amounts is equal to or larger than the threshold value, there is a high possibility that the object blocking the light is not located on the solar panel 2C and all of the solar panels 2C are irradiated with the light. Accordingly, if each of the power generation amounts is equal to or larger than the threshold value, the processor 10 switches the display 2B from the on state to the off state in the processing of Step S007. In the meanwhile, if at least one of the generation power amounts is smaller than the threshold value, the processing returns to Step S001.

The above description is based on an assumption that the smartwatch 1 is attached to the left hand 14 and the sleeve 13 of the cloth covers the solar panel 2C from the left side of the paper sheet in the arrangement in FIG. 4, for example. In contrast, if the smartwatch 1 is attached to a right hand, the sleeve 13 covers the solar panel 2C from a right side of the paper sheet, thus the processing in Step S004 is reversed. That is to say, Step S004 proceeds as "the power generation amount in the third column is at least the threshold value smaller than the power generation amount in the first column?" Accordingly, if the processor 10 can determine that the smartwatch 1 is attached to the right hand based on, for example, setting information of the smartwatch 1 including information for specifying an arm to which the smartwatch 1 is attached, the processor 10 may change the processing in Step S004 to the operation described above. The processor 10 may determine whether the smartwatch 1 is attached to the right hand or the left hand 14 from an accumulated power generation amount in the first column and an accumulated power generation amount in the third column. In the smartwatch 1, it is considered that a side farther away from the sleeve 13 has a lower frequency of being covered by the sleeve 13. Accordingly, in the smartwatch 1, it is considered that the accumulated value of the power generation amount on the side farther away from the sleeve 13 is larger than the accumulated value of the power generation amount on a side closer to the sleeve 13. Thus, the processor 10 calculates an accumulated power generation amount from a predetermined period of time before a current time on each solar panel 2C of the smartwatch 1. Then, the processor 10 obtains the accumulated power generation amount in the first column and the accumulated power generation amount in the third column based on the accumulated power generation amount which has been calculated. The accumulated power generation amount in the first column may be a maximum accumulated power generation amount in the accumulated power generation amounts of the solar panels 2Ca, 2Cb, and 2Cc belonging to the first column, or may also be a total accumulated power generation amount in the solar panels 2Ca, 2Cb, and 2Cc. In a similar manner, the accumulated power generation amount in the third column may be a maximum accumulated power generation amount in the accumulated power generation amounts of the solar panels 2Cg, 2Ch, and 2Ci belonging to the third column, or may also be a total accumulated power generation amount in the solar panels 2Cg, 2Ch, and 2Ci. If the accumulated power generation amount in the third column is larger than the accumulated power generation amount in the first column, the processor 10 determines that the smartwatch 1 is attached to the left hand 14. In the meanwhile, if the accumulated power generation amount in the first column is larger than the accumulated power generation amount in the third column, the processor 10 determines that the smartwatch 1 is attached to the right hand.

The processor 10 may determine whether the smartwatch 1 is attached to the right hand or the left hand 14 using a sensor such as the accelerometer 5B. For example, if the user wears the smartwatch 1 on the left hand 14 with his/her left arm downward, a gravity direction is directed from the left side toward the right side of the paper sheet in FIG. 4, for example. If the user wears the smartwatch 1 on the right hand and walks, the gravity direction is directed from the right side toward the left side of the paper sheet in FIG. 4, for example. Accordingly, the processor 10 can specify whether the smartwatch 1 is attached to the right hand or the left hand based on the direction of the gravity detected by the accelerometer 5B.

The switching of the state of the display 2B between the on state and the off state is described above, however, the state of the display 2B needs not be necessarily switched between the on state and the off state. For example, the state of the display 2B may be switched between a high luminance state and a low luminance state. The state of the display 2B may be switched between a multiple color display state and a single color display state. The state of the display 2B may be switched between a high consumed power state and a low consumed power state.

The example of comparing the power generation amount in the solar panel 2C belonging to the first column and the power generation amount in the solar panel 2C belonging to the third column is described above, however, there is necessarily no need to compare the power generation amount in the solar panel 2C belonging to the first column and the power generation amount in the solar panel 2C belonging to the third column. The processor 10 needs to compare the power generation amount in the solar panel 2C close to the sleeve 13 of the cloth of the user and the power generation amount in the solar panel 2C farther away from the sleeve 13. That is to say, the processor 10 needs to compare the power generation amounts of the solar panels 2C disposed in a position distant from each other in the short-side direction of the band 1B.

Accordingly, in the processing of Steps S004 and S006, for example, the power generation amounts in the first column and the third column but the power generation amounts in the second column and the third column may be compared. The processor 10 may calculate an average value or a total value of the electrical power amount generated by the solar panel 2C belonging to the first column and the electrical power amount generated by the solar panel 2C in the second column to compare the calculated numerical value with the electrical power amount generated by the solar panel 2C belonging to the third column.

If the processor 10 performs the processing based on the power generation amount in the solar panel 2C belonging to the second column, the processor 10 can determine whether a central part which is a region corresponding to the solar panel 2C belonging to the second column is covered by the object blocking the light in the display 2B. If the region extending into the central part is covered by the object blocking the light in the display 2B, it is assumed that the user does not use the display 2B with high probability.

The example of determining whether or not the plurality of solar panels 2C generate the electrical power is described above, however, if the smartwatch 1 has a means of being able to detect a shadowed region in the single solar panel 2C, the processor 10 may perform control based on an area of the shadowed region. For example, if a half of the area of the solar panel 2C is shadowed, the processor 10 may change the display 2B to the off state.

<Second Embodiment>

Next, the second embodiment is described. A description of a configuration of the second embodiment in common with that of the first embodiment is omitted.

The smartwatch 1 according to one embodiment detects a movement of an object which covers the solar panel 2C and blocks the light (for example, the sleeve 13 of the cloth, for example).

The processor 10 included in the smartwatch 1 measures a transition of the power generation amount in the solar panel (2Ca, 2Cb, and 2Cc) belonging to the first column in FIG. 4 (the power generation amount in the first column) and a transition of the power generation amount in the solar panel (2Cg, 2Ch, and 2Ci) belonging to the third column (the power generation amount in the third column). If the power generation amount in the solar panel (2Ca, 2Cb, and 2Cc) belonging to the first column reduces and the power generation amount in the solar panel (2Cg, 2Ch, and 2Ci) belonging to the third column also reduces in the state where the display 2B is in the on state, the processor 10 performs the processing of changing the display 2B from the on state to the off state.

If the user finishes using the smartwatch 1 and performs a movement such as a movement of the arm downward, for example, there may be a case where the sleeve 13 covers all of the solar panels 2C. At this time, the smartwatch 1 changes the display 2B from the on state to the off state by the processing described above. Accordingly, the smartwatch 1 transitions to the low consumed power state immediately without a particular additional operation performed by the user.

In contrast, if the power generation amount in the solar panel (2Cg, 2Ch, and 2Ci) belonging to the third column increases and the power generation amount in the solar panel (2Ca, 2Cb, and 2Cc) belonging to the first column also increases in the state where the display 2B is in the off state, the processor 10 performs the processing of changing the display 2B from the off state to the on state.

According to the processing described above, if the state where each solar panel 2C included in the smartwatch 1 is covered by the object blocking the light changes to the state where all of the solar panel 2C are irradiated with the light, the smartwatch 1 changes the display 2B from the off state to the on state. Accordingly, when the user is to start using the smartwatch 1, the display 2B of the smartwatch 1 enters the on state even if the operation of changing the display 2B to the on state is not performed by the user.

Figure 12:
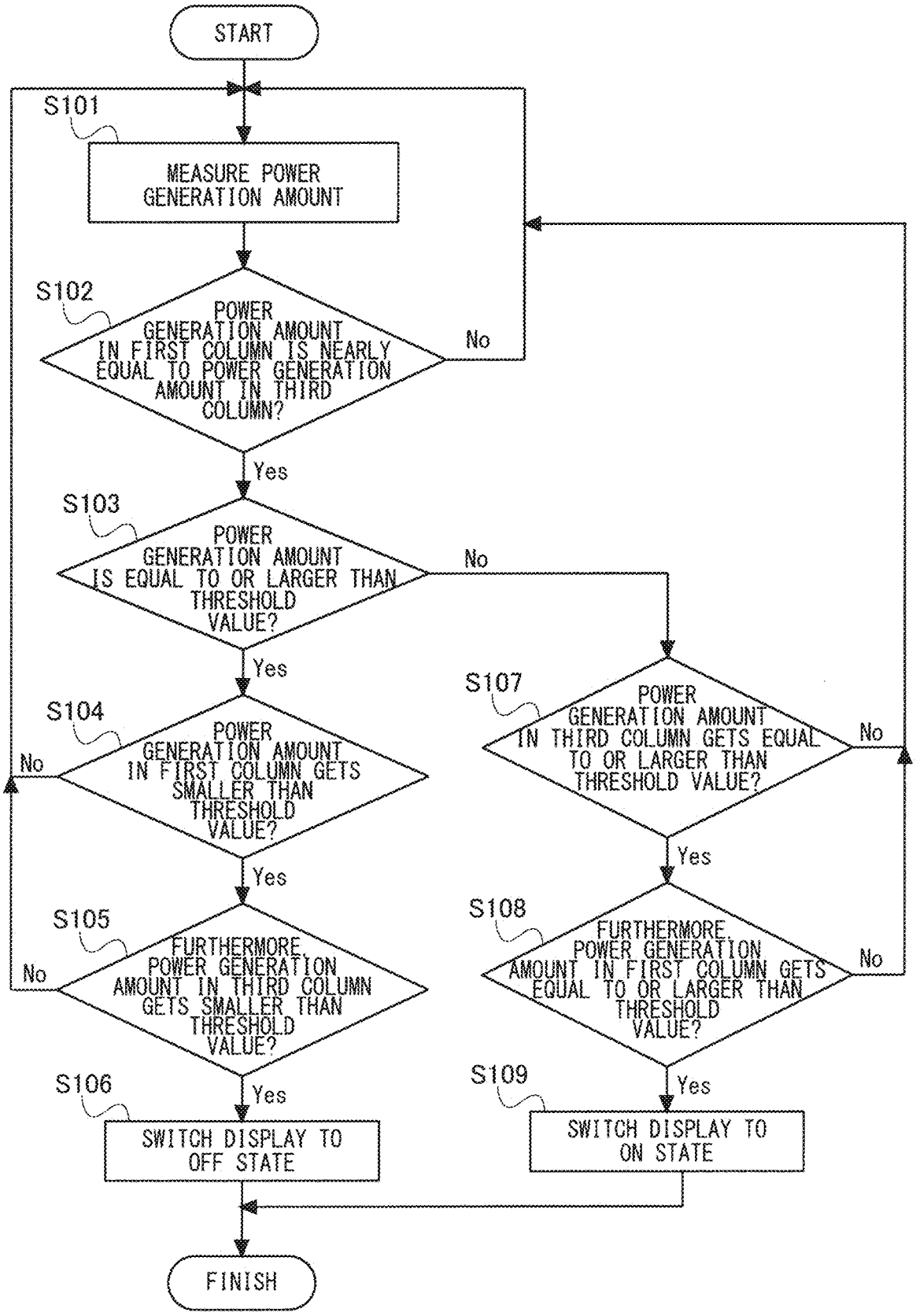
FIG. 12 illustrates a flow chart showing one example of a flow of processing according to an embodiment.

The processing executed in the smartwatch 1 according to the second embodiment is described hereinafter using a flow chart in FIG. 12.

In Step S101, the processor 10 included in the smartwatch 1 measures the power generation amount of each of the solar panels 2Ca to 2Ci, and subsequently proceeds with the processing to Step S102.

Next, in Step S102, the processor 10 compares the power generation amount in the first column and the power generation amount in the third column, and if a difference between those power generation amounts is smaller than a threshold value, the processor 10 proceeds with the processing to Step S103.

In Step S103, the processor 10 determines whether the power generation amount in the solar panel 2C is equal to or larger than a threshold value. The power generation amount in the solar panel 2C may be the power generation amount in the first column, or also may be the power generation amount in the third column The power generation amount in the solar panel 2C may be the power generation amount in all of the solar panels 2C. If the power generation amount is equal to or larger than the threshold value in Step S103, the processor 10 proceeds with the processing to Step S104.

If the processor 10 detects that the power generation amount in the first column changes to less than the threshold value in Step S104, the processor 10 determines that the illuminance in a region on an upper side of the solar panel 2C in the first column on the upper surface of the body 1A decreases, and proceeds with the processing to Step S105.

If the processor 10 detects that the power generation amount in the first column changes to less than the threshold value and also detects that the power generation amount in the third column changes to less than the threshold value in Step S105, the processor 10 determines that the illuminance in a region on an upper side of the solar panel 2C in the first column and the third column on the upper surface of the body 1A decreases, and proceeds with the processing to Step S106.

If the processing proceeds to Step S106 via the procedure described above, the processor 10 estimates that the object blocking the light (for example, the sleeve 13 of the cloth) covers all of the solar panels 2C, and changes the display 2B from the on state to the off state. If the display is in the off state before the processor 10 changes the display 2B from the on state to the off state, Step S106 may not be executed.

If the processor 10 determines that the power generation amount in the first column changes to less than the threshold value in Step S104, the processor 10 returns the processing to Step S101.

If the processor 10 detects that the power generation amount in the first column changes to the threshold value or larger before detecting that the power generation amount in the third column changes to less than the threshold value in Step S105, the processor 10 returns the processing to Step S101.

If the processor 10 determines that the power generation amount in the solar panel 2C is not equal to or larger than the threshold value in Step S103, the processor 10 proceeds with the processing to Step S107.

In Step S107, the processor 10 checks the power generation amount in the third column, and if the processor 10 determines that the power generation amount is equal to or larger than the threshold value, the processor 10 determines that the illuminance in the region on the upper side of the solar panel 2C in the third column on the upper surface of the body 1A increases, and proceeds with the processing to Step S108.

In Step S108, if the processor 10 determines that the power generation amount of the solar panel 2D belonging to the first column changes to the threshold value or larger after detecting that the power generation amount in the third column changes to threshold value or larger, the processor 10 determines that the illuminance in the region on the upper side of the solar panel 2C in the first column and the third column on the upper surface of the body 1A increases, and proceeds with the processing to Step S109.

In Step S109, the processor 10 estimates that the object which has covered the solar panel 2C and blocked the light (for example, the sleeve 13 of the cloth) is removed, and changes the display 2B to the on state. If the display 2B is in the on state before the switching, Step S109 may not be executed.

In step S106, the processor 10 may perform processing of increasing sensitivity of the microphone 7A together with the processing of changing the display 2B to the off state. The processor 10 may not perform the processing of changing the display 2B to the off state but perform the processing of increasing the sensitivity of the microphone 7A.

In the state where the sleeve 13 of the cloth covers the solar panel 2C, there is a high possibility that the sleeve 13 of the cloth also covers the microphone 7A included in the smartwatch 1 in the similar manner. At this time, there is a possibility that the sleeve 13 of the cloth absorbs the sound, thereby reducing a sound collection performance of the microphone 7A. Accordingly, the sound collection performance of the microphone 7A is improved by performing the processing of increasing the sensitivity of the microphone 7A.

In step S106, the processor 10 may perform processing of increasing a volume of the speaker 7B together with the processing of changing the display 2B to the off state. The processor 10 may not perform the processing of changing the display 2B to the off state but perform the processing of increasing the volume of the speaker 7B.

In the state where the sleeve 13 of the cloth covers the solar panel 2C, there is a possibility that the sleeve 13 of the cloth absorbs the sound from the speaker 7B. The sound from the speaker 7B can be easily heard by increasing the volume of the speaker 7B.

The processor 10 may perform both the processing of increasing the sensitivity of the microphone 7B and the processing of increasing the volume of the speaker 7A together with the processing of changing the display 2B from the on state to the off state. The processor 10 may not perform the processing of changing the display 2B from the on state to the off state but perform both the processing of increasing the sensitivity of the microphone 7B and the processing of increasing the volume of the speaker 7A. Accordingly, particularly even when a voice call is performed using the smartwatch 1 with the smartwatch 1 being covered by the sleeve 13, the voice call can be carried out at a volume large enough for both the user who wears the smartwatch 1 and the other party.

The processor 10 may switch a method of notification. The smartwatch 1 can use, as the method of notification to the user, a display of information on the display 2B, a light emission of the LED 8B for the notification, an output of a sound from the speaker 7B, and a vibration by the vibrator 8A, for example. If it is considered that the sleeve 13 of the cloth covers the display 2B (Yes in Steps S104 and 105), the processor 10 may switch the method of notification in Step S106 to the output of the sound from the speaker 7B or the vibration by the vibrator 8A even when the display of the information on the display 2B or the light emission of the LED 8B for the notification are set as the method of notification in the setting of the smartwatch 1. For example, the processor 10 changes the notification mode from the light emission of the LED 8B to the vibration of the vibrator 8A in Step S106. Since the notification is performed by the light, which has been emitted from the LED 8B, passing through the object blocking the light, the processor 10 may increase emission intensity of the LED 8B. If it is considered that the sleeve 13 is removed from over the display 2B (Yes in Steps S107 and 108), the processor 10 may switch the method of notification in Step S109 from the output of the sound from the speaker 7B or the vibration by the vibrator 8A to the display of the information on the display 2B or the light emission of the LED 8B for the notification. For example, the processor 10 changes the notification mode from the vibration of the vibrator 8A to the light emission of the LED 8B in Step S109.

If the processor 10 determines that the power generation amount in the third column does not change to the threshold value or larger in Step S107, the processor 10 returns the processing to Step S101.

If the processor 10 does not detect that the power generation amount in the third column changes to the threshold value or larger in a predetermined period of time after detecting that the power generation amount in the first column changes to the threshold value or larger in Step S108, the processor 10 returns the processing to Step S101.

The processing according to the first embodiment and the second embodiment may be executed in accordance with the signal of the sensor such as an accelerometer and a gyro sensor detecting a posture of the smartwatch 1. In this case, for example, the processor 10 of the smartwatch 1 specifies the change in the position and the posture of the smartwatch 1 based on the output signals of the accelerometer 5B and the gyro sensor 5C. Then, if the processor 10 detects the movement of the smartwatch 1 of directing the display 2B to a side of the user, for example, based on the specified result, the processor 10 executes the processing of Step S001 and the subsequent steps in FIG. 5 in the first embodiment or the processing of Step S101 and the subsequent steps in FIG. 12 in the second embodiment. According to such a type of processing, the smartwatch 1 according to one embodiment can detect the state where the user is to see the display 2B of the smartwatch 1 more accurately. As a result, a total number of malfunctions of the smartwatch 1 is reduced. Thus, the reduction in the consumed power and the improvement of the operability can be achieved.

The processing according to the first embodiment and the second embodiment may be executed in accordance with a temperature. The sleeve 13 of the cloth which the user wears is considered as one example of the object which blocks the light to the solar panel 2C of a device attached to a wrist. However, the state where the sleeve 13 of the cloth blocks the light to the solar panel 2C occurs when the cloth has long sleeves. Accordingly, if the temperature is high enough to wear a thin cloth (for example, 25° C. or higher), the processor 10 may not execute the processing according to the first embodiment and the second embodiment. Unnecessary processing is thereby reduced. As a result, the consumed power is reduced. The temperature may be measured by a thermometer included in the smartwatch 1, or may also be obtained from Internet via communication using a communication unit or from the other device which can perform communication.

If either the light to the solar panel 2C in the first column or the light to the solar panel 2C in the third column is not frequently blocked, there is a high possibility that the sleeve 13 of the cloth which the user wears does not cover the device attached to the wrist, but the cloth has short sleeves, for example. Thus, if the state where either the light to the solar panel 2C in the first column or the light to the solar panel 2C in the third column is not blocked has not occurred for a predetermined period of time, the processing according to the first embodiment and the second embodiment may not be executed.

The processing according to the first embodiment and the second embodiment may be executed in accordance with a time. If it is not bright around the smartwatch 1, the processor 10 has difficulty performing the above processing accurately. Thus, the processor 10 may perform the above processing only during daytime, for example.

The processing of Step S106 may be executed only if the processing proceeds from Step S104 to Step S106 in a predetermined period of time. That is to say, the processing of Step S106 may be executed only if the power generation amount in the third column changes from the second threshold value or larger to less than the second threshold value in the predetermined period of time after the power generation amount in the first column changes from the first threshold value or larger to less than the first threshold value. The processing of Step S109 may be executed if the processing proceeds from Step S107 to Step S109 in a predetermined period of time. That is to say, the processing of Step S109 may be executed only if the power generation amount in the first column changes from less than the first threshold value to the first threshold value or larger in the predetermined period of time after the power generation amount in the third column changes from less than the second threshold value to the second threshold value or larger. As described above, the transition of the display 2B to the on state or the off state is executed only if the power generation amount changes in the first column and the third column in the predetermined period of time, thus a possibility of an erroneous detection of the movement of the user seeing the display 2B can be reduced.

The processing described in the above embodiment is implemented in the smartwatch 1 which is the watch type device attached to the wrist, however, it may be implemented in the other electronic device.

Figure 13:
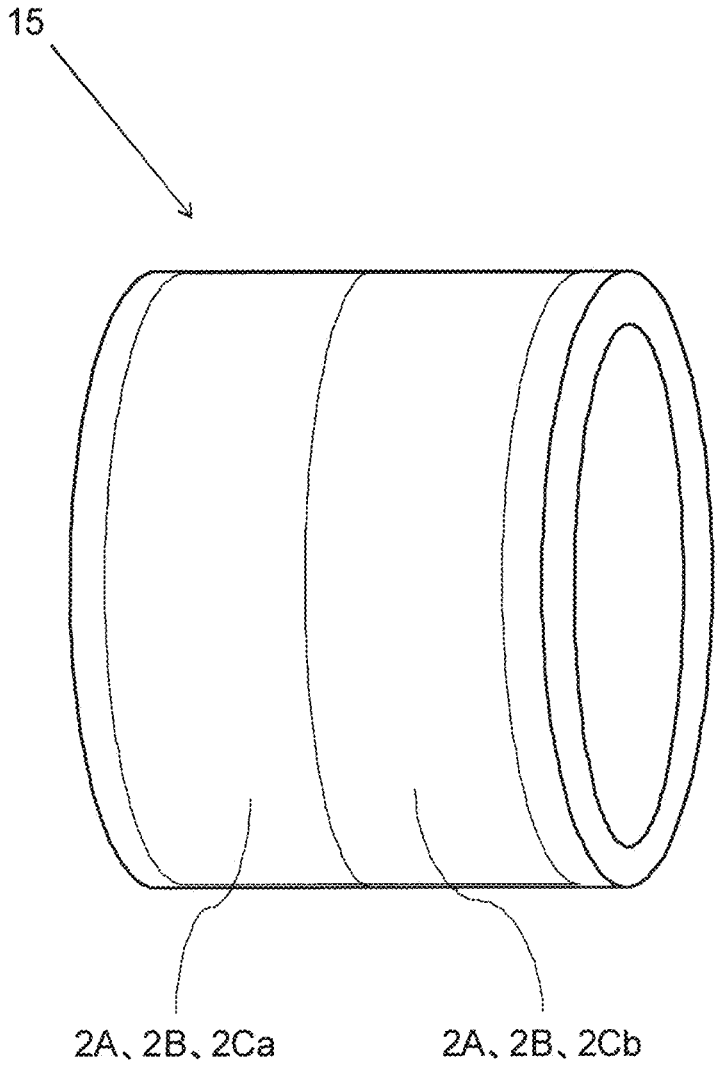
FIG. 13 illustrates a drawing showing one example of an electronic device according to an embodiment.

The processing described in the above embodiment may be implemented in a bracelet type terminal 15 shown in FIG. 13, for example The bracelet type terminal 15 is an annular terminal using a flexible display. The bracelet type terminal 15 does not have the band 1B. A short-side direction in the bracelet type terminal 15 is a direction in which the arm, to which the bracelet type terminal 15 is attached, extends. The plurality of solar panels 2C included in the bracelet type terminal 15 include the two solar panels of the solar panels 2Ca and the solar panel 2Cb.

Figure 14:
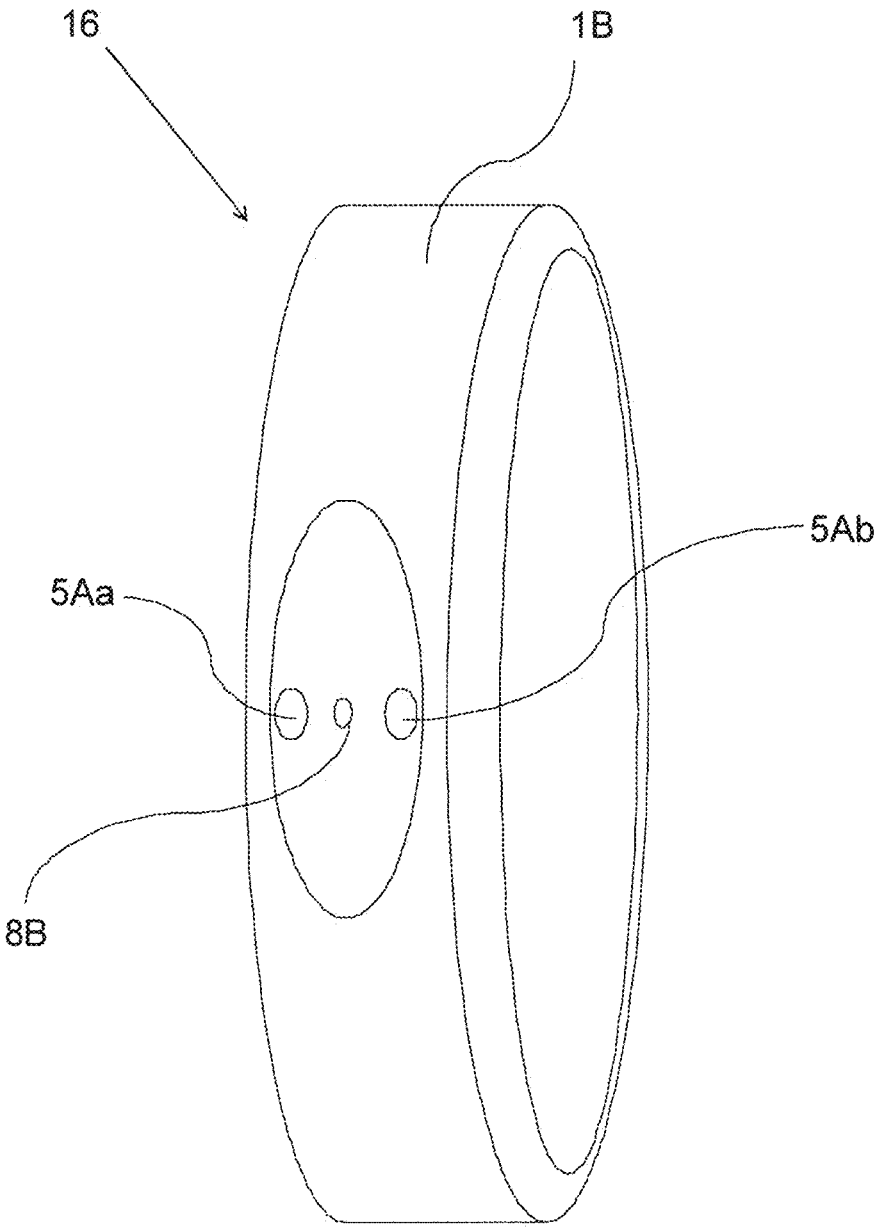
FIG. 14 illustrates a drawing showing one example of an electronic device according to an embodiment.

The processing described in the above embodiment may be implemented in a wristband type terminal 16 shown in FIG. 14, for example. The wristband type terminal 16 is a terminal in which the body 1A is fitted in the band 1B. The wristband type terminal 16 comprises the vibrator 8A and the LED 8B for transmitting the notification, and does not have the display 2B. If the processor 10 determines that the wristband type terminal 16, which is attached to the left hand, is covered by the sleeve 13 based on the signals of the illuminance sensor 5Aa and the illuminance sensor 5Ab, the processor 10 may switch the means of transmitting the notification between the vibrator 8A and the LED 8B.

Figure 15:
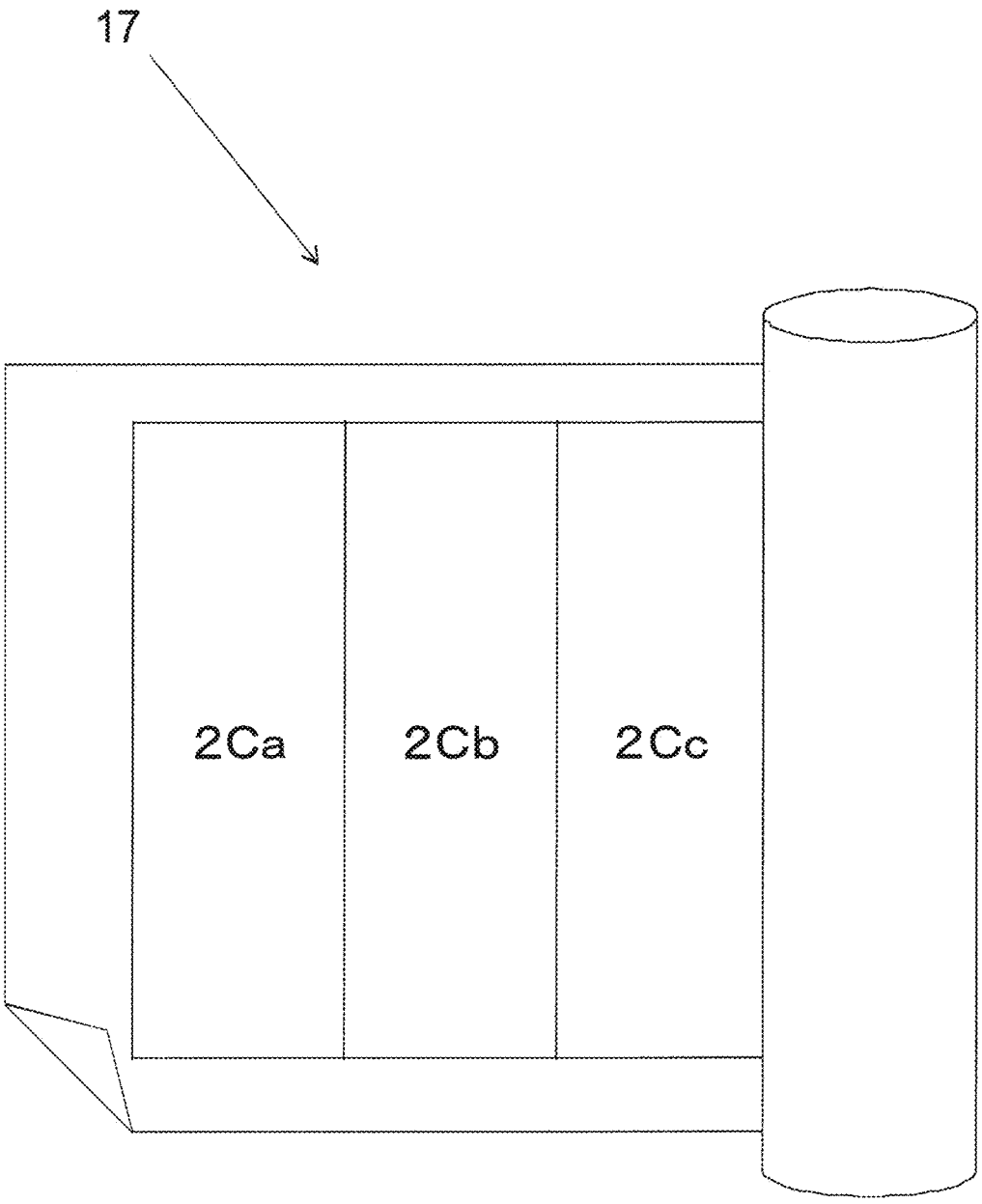
FIG. 15 illustrates a drawing showing one example of an electronic device according to an embodiment.

For example, in a terminal such as a winding type terminal 17 using a flexible display shown in FIG. 15, the processor 10 may change a state of only a region corresponding to a part receiving the light of the solar panel 2C in the flexible display to the on state. The present disclosure can be further applied to, for example, a feature phone, a tablet terminal, a PDA, a digital camera, a music player, and a game machine.

The art of appended claims has been described with respect to specific embodiments for a complete and clear disclosure. However, the appended claims are not to be thus limited but are to be construed as embodying all modifications and alternative constructions that may occur to one skilled in the art which fairly fall within the basic teaching herein set forth.

The invention claimed is:

1. An electronic device, comprising:

a body configured to be attached to a part of a human body, wherein the body comprises:

a first detector configured to detect illuminance on a surface of the body;

a second detector other than the first detector and configured to detect the illuminance on the surface; and at least one processor configured to execute turning on/off a function of the electronic device in response to the at least one processor determining that at least one of first illuminance detected by the first detector and second illuminance detected by the second detector changes.

2. The electronic device according to claim 1, wherein at least one of the first detector and the second detector comprises a photoelectric convertor configured to generate electrical power upon receiving light, and the at least one processor is configured to determine that at least one of the first illuminance and the second luminance changes in response to determining that a power generation amount in the photoelectric convertor changes.

3. The electronic device according to claim 2, wherein the body further includes a display, and the photoelectric convertor is placed on the display and is configured to transmit at least part of light having a wavelength in a range of 360 nm to 830 nm.

4. The electronic device according to claim 1, wherein at least one of the first detector and the second detector comprises a photodiode.

5. The electronic device according to claim 1, wherein the body further includes a display, and in response to the at least one processor determining that the first illuminance is equal to or larger than a first threshold value and the second illuminance changes from a second threshold value or larger to less than the second threshold value, the at least one processor is configured to turn off the display as turning off the function of the electronic device.

6. The electronic device according to claim 1, wherein the body further includes a display, and in response to the at least one processor determining that the first illuminance is equal to or larger than a first threshold value and the second illuminance changes from less than a second threshold value to the second threshold value or larger, the at least one processor is configured to turn on the display as turning on the function of the electronic device.

7. The electronic device according to claim 1, wherein in response to the at least one processor determining that the second illuminance changes from a second threshold value or larger to less than the second threshold value after the first illuminance changes from a first threshold value or larger to less than the first threshold value, the at least one processor is configured to execute predetermined processing.

8. The electronic device according to claim 7, wherein the body further includes a display, and the predetermined processing includes turning the display from an on state to an off state.

9. The electronic device according to claim 7, wherein the body further comprises a microphone, and the predetermined processing includes increasing sensitivity of the microphone to a sound.

10. The electronic device according to claim 7, wherein the body further comprises a light-emitting unit and a vibrator, and the predetermined processing includes changing a mode from a first mode of transmitting a notification by a light emission of the light-emitting unit to a second mode of transmitting a notification by a vibration of the vibrator.

11. The electronic device according to claim 7, wherein in response to the at least one processor determining that the second illuminance changes from the second threshold value or larger to less than the second threshold value in a predetermined period of time after the first illuminance changes from the first threshold value or larger to less than the first threshold value, the at least one processor is configured to execute the predetermined processing.

12. The electronic device according to claim 1, wherein in response to the at least one processor determining that the second illuminance changes from less than a second threshold value to the second threshold value or larger after the first illuminance changes from less than a first threshold value to the first threshold value or larger, the at least one processor is configured to execute predetermined processing.

13. The electronic device according to claim 12, wherein the body further includes a display, and the predetermined processing includes turning the display from an off state to an on state.

14. The electronic device according to claim 12, wherein the body further comprises a microphone, and the predetermined processing includes reducing sensitivity of the microphone to a sound.

15. The electronic device according to claim 12, wherein the body further comprises a light-emitting unit and a vibrator, and the predetermined processing includes changing a mode from a first mode of transmitting a notification by a vibration of the vibrator to a second mode of transmitting a notification by a light emission of the light-emitting unit.

16. The electronic device according to claim 12, wherein in response to the at least one processor determining that the second illuminance changes from the second threshold value or larger to the second threshold value or less after the first illuminance changes from the first threshold value or larger to the first threshold value or less, the at least one processor is configured to execute the predetermined processing.

17. The electronic device according to claim 1, wherein, when the body is attached to a left hand, the first detector is configured to be located on an elbow side of the left hand, and the second detector is configured to be located on a finger side of the left hand.

18. A computer-readable non-transitory recording medium storing a control program to be executed by an electronic device comprising a body, wherein the body includes a first detector for detecting illuminance on a surface of the body;

a second detector, other than the first detector, for detecting the illuminance on the surface; and at least one processor, the control program, when executed by the at least one processor, causing the at least one processor to execute turning on/off a function of the electronic device in response to the at least one processor determining that at least one of first illuminance detected by the first detector and second illuminance detected by the second detector changes.

* * * * *